US010099471B2

(12) United States Patent
Usui et al.

(10) Patent No.: US 10,099,471 B2
(45) Date of Patent: Oct. 16, 2018

(54) SCREEN PRINTING MASK AND MANUFACTURING METHOD THEREOF

(71) Applicant: Asahitec Co., Ltd., Seto-shi (JP)

(72) Inventors: Tsuneaki Usui, Seto (JP); Gen Suzuki, Seto (JP)

(73) Assignee: ASAHITEC CO., LTD., Seto-Shi (JP)

( * ) Notice: Subject to any disclaimer, the term of this patent is extended or adjusted under 35 U.S.C. 154(b) by 0 days.

(21) Appl. No.: 14/858,247

(22) Filed: Sep. 18, 2015

(65) Prior Publication Data

US 2016/0129685 A1 May 12, 2016

(30) Foreign Application Priority Data

Nov. 12, 2014 (JP) ..... 2014-229608

(51) Int. Cl.

| | |
|---|---|
| ***B41F 15/34*** | (2006.01) |
| ***B41F 15/36*** | (2006.01) |
| *B41N 1/24* | (2006.01) |
| *H05B 3/26* | (2006.01) |

(52) U.S. Cl.

CPC ..... *B41F 15/36* (2013.01); *B41N 1/247* (2013.01); *B41F 15/34* (2013.01); *B41N 1/24* (2013.01); *B41N 1/243* (2013.01); *H05B 3/26* (2013.01)

(58) Field of Classification Search

CPC . B41F 15/34; B41F 15/36; B41N 1/24; B41N 1/243; B41N 1/247; H05B 3/26

See application file for complete search history.

(56) References Cited

U.S. PATENT DOCUMENTS

| | | | | |
|---|---|---|---|---|
| 4,958,560 A | | 9/1990 | Collins | |
| 5,361,695 A | * | 11/1994 | Takagi | B41F 15/36 101/127 |
| 5,645,975 A | * | 7/1997 | Gybin | B41C 1/14 101/127 |
| 2009/0173245 A1 | * | 7/2009 | Irisawa | B41C 1/14 101/128.21 |

(Continued)

FOREIGN PATENT DOCUMENTS

| | | | | |
|---|---|---|---|---|
| CN | 102214725 A | * | 10/2011 | Y03P 70/521 |
| EP | 0281351 A1 | | 9/1988 | |

(Continued)

*Primary Examiner* — Jill Culler
*Assistant Examiner* — Marissa Ferguson Samreth
(74) *Attorney, Agent, or Firm* — J-Tek Law PLLC; Jeffrey D. Tekanic; Scott T. Wakeman

(57) ABSTRACT

A screen printing mask (10) includes a main mesh (20), a main resin layer (30), and an additional net-like section (50A). The main resin layer (30) is provided on the main mesh (20) and has a through-hole (35). The additional net-like section (50A) may have a first additional layer (50Aa) and a second additional layer (50Ab). The first additional layer (50Aa) is provided on the main mesh (20), together with the main resin layer (30) by curing, through absorption of light, photocurable resin applied onto the main mesh (20). The second additional layer (50Ab) is provided on the first additional layer (50Aa) by curing, through absorption of light, a photocurable resin applied onto the first additional layer (50Aa). The additional net-like section (50A) has a greater thickness or depth than the main resin layer (30) so that a thicker portion is printed on a substrate in accordance therewith.

22 Claims, 19 Drawing Sheets

(56) References Cited

U.S. PATENT DOCUMENTS

| | | | | |
|---|---|---|---|---|
| 2011/0259218 | A1* | 10/2011 | Becker | B41N 1/247 101/127 |
| 2013/0032048 | A1* | 2/2013 | Falcon | B41F 15/36 101/128.4 |
| 2014/0103563 | A1* | 4/2014 | Gray | A61F 13/15577 264/101 |
| 2015/0101500 | A1* | 4/2015 | van Heijningen | B05C 17/06 101/127 |

FOREIGN PATENT DOCUMENTS

| | | | |
|---|---|---|---|
| JP | S63233838 | A | 9/1988 |
| JP | H0392390 | A | 4/1991 |
| JP | H05338369 | A | 12/1993 |

* cited by examiner

SCREEN PRINTING MASK AND MANUFACTURING METHOD THEREOF

BACKGROUND OF THE INVENTION

1. Field of the Invention

The present invention relates to a mask for screen printing and methods for manufacturing the same.

2. Description of the Related Art

Heating wires are typically disposed on the rear glass (rear window or rear windshield) of an automobile to prevent or clear fogging (condensation). Specifically, two bus bars extend in the vertical direction and are disposed on the left and right sides of the rear glass. A plurality of heating wires extends in the transverse direction (horizontal direction) between the two bus bars. The pair of bus bars and the heating wires are typically applied to the rear glass by screen printing.

In addition, a border (black enamel coating or "frit") formed by a black ceramic ink is typically disposed along the peripheral edge of the front glass (front window or front windshield) of the automobile. A main portion of the border is filled in with the ceramic ink, i.e. it is continuous and opaque, while a discontinuous pattern, e.g., made up of a plurality of dots (i.e. a dot matrix), is disposed along the inner edge of the continuous opaque band. The border is also typically applied to the front glass by screen printing.

Screen printing generally includes the following features. A printing mask is prepared by forming a liquid-impermeable resin layer (stencil or blocking stencil) on a mesh material (main mesh), such as, e.g., a woven fabric having minute openings or a metal screen. One or more through-holes (openings or open spaces) is (are) formed in the resin layer (main resin layer) in accordance with a predetermined printing pattern. The stencil with the through-hole(s) appears as a negative image of the pattern to be printed on a substrate Ink is then placed on the mesh, and a squeegee is moved (slid) across the mesh while pressing the ink and the mesh. As a result, ink passes through the through-hole(s) of the resin layer, and the predetermined pattern is printed on the substrate (material to be printed). In doing so, the ink is printed on the substrate substantially uniformly (i.e. the ink is applied with an identical thickness across the pattern), and the thickness of the ink basically corresponds to the thickness of the mesh (also referred to as the "mesh thickness").

The bus bars disposed on the rear glass of automobiles are ordinarily designed to have one or more parts (portion(s) or area(s)) that is (are) thicker than the remaining portions of the bus bars. Specifically, the greater part of the bus bars is formed to be very thin, e.g., to minimize manufacturing costs, while one or more parts of the bus bars is (are) formed thicker than other portions, e.g., in order to moderate (reduce) the electrical resistance of the bus bars, or to provide a contact pad for an antenna terminal therein.

With respect to the border provided along the peripheral edge of the front glass of automobiles, the continuous portion of the border has to be printed thickly, since a thin border might be light permeable (i.e. the border should be opaque for aesthetic and technical reasons). Furthermore, the continuous portion (more accurately, the greater part thereof, excluding the peripheral edge) can be printed roughly (i.e. with a rough surface) without any problems. On the other hand, the dot matrix printed along the inner edge of the border has to be printed finely/precisely, since both printed and non-printed sites are intricately present within the dot matrix. That is, the dots of the dot matrix should have precise or sharp circular shapes/edges, e.g., to provide an appealing aesthetic appearance.

In order to increase the thickness of certain portions (i.e. to form thick sections) of the resulting printed pattern, conventional screen printing involves the following steps. First, screen printing is performed once, across the entire design, at the same thickness. Subsequently, only the portion(s) at which a thick section must be formed is (are) screen-printed again a second time. However, this approach is inefficient, since the screen printing operation has to be carried out twice. Furthermore, two printing masks are required, which entails higher costs. Moreover, special alignment measures/devices may be necessary to ensure that the thick portion(s) is (are) accurately printed at the intended location(s) within the think portion(s) of the printed design/structure.

As was mentioned above, the thickness of the printed ink applied by screen printing is determined by the thickness of the mesh (mesh thickness). Thus, if a relatively thick mesh is used, the amount of printing liquid (ink) that is held in the mesh (i.e. in the through-holes) is relatively large. Accordingly, the printing agent can be applied relatively thickly onto the substrate (material to be printed) using a relatively thick mesh.

Coarse or rough printing results when a mesh having a large mesh thickness is used, whereas fine (precise) printing results when a mesh having a small (thin) mesh thickness is used.

It is noted that U.S. Pat. No. 4,958,560 and its counterpart Japanese Patent Application Publication No. S63-233838 disclose a printing technique for increasing the thickness of certain portions of the printed design. This technique involves providing a local support between the screen material (main mesh) and the substrate. The local support is formed as a patch comprised of a plurality of spots, or comprised of another screen material (mesh).

However, the specific manner in which the local support (in particular, the spots) is provided in the main mesh is unclear. Furthermore, if the patch is a screen material and is bonded to the main screen (main mesh) using an adhesive, some of the adhesive may clog the openings and may thus create a printing problem if the printing agent (ink) can no longer pass through the screen.

SUMMARY OF THE INVENTION

It is an object of the present invention to disclose one or more techniques for printing one or more portions of a screen printed design more thickly than one or more other portions thereof in a simple and reliable manner.

In a first aspect of the present teachings, a screen printing mask for performing screen printing on a material to be printed on (substrate) may include a main resin layer provided on a main mesh by curing, through absorption of light, photocurable resin that is applied onto the main mesh. The main resin layer has at least one through-hole. Furthermore, at least one additional net-like section is provided on the main mesh by curing, through absorption of light, photocurable resin that is applied onto the main mesh. The additional net-like section(s) is (are) disposed within the through-hole(s) of the main resin layer.

Screen printing masks according to the present teachings can be utilized in the following manner to achieve the following functions and effects. Specifically, ink is placed on the printing mask and a squeegee is moved (slid) over the main mesh and main resin layer while pressing the ink and the main mesh. As a result, ink passes through the through-hole(s) of the main resin layer, and the material to be printed on (substrate) is printed according to the predetermined pattern defined by the main resin layer.

The thickness (mesh thickness) of the portion (which will be referred to as the "thick mesh section") at which the additional net-like section(s) is (are) provided on the main mesh is greater than the thickness (mesh thickness) of the main mesh alone. Accordingly, more ink is held in the additional net-like section(s) than in the main mesh alone. When the ink migrates to the substrate (material to be printed on), the portion(s) of the printed design corresponding to (underneath) the thick mesh section(s) is (are) thicker than the portion(s) of the printed design corresponding to (underneath) the main mesh alone. Thus, the portion(s) of the printed material (design) that corresponds to the portion of the main mesh alone is (are) printed relatively thinly (i.e. it/they will have a thickness corresponding to the mesh thickness of the main mesh alone), whereas the portion(s) corresponding to the thick mesh section(s) is (are) printed relatively thickly (i.e. it/they will have a thickness corresponding to the mesh thickness of the thick mesh section), so that a thick section is formed in the printed design at the (each) thick mesh section.

In such a printing mask, the additional net-like section(s) is (are) provided on the main mesh by curing, through absorption of light, photocurable resin that has been applied onto the main mesh. As a result, the (each) additional net-like section becomes solidly affixed (bound) to the main mesh, without the need for any adhesive. As a result, one or more predetermined portions is (are) printed thickly (thick section(s) is (are) formed), easily and reliably, without the occurrence of problems such as positional deviation (alignment errors) of the additional net-like section(s) with respect to the main mesh, or clogging of the main mesh by an adhesive.

In a second aspect of the present teachings, the (each) additional net-like section is comprised of a first additional layer and a second additional layer disposed on (bound to) the first additional layer. The first additional layer is provided (formed), together with the main resin layer, by a photocurable resin.

In such a screen printing mask, the positional relationship of the main resin layer (through-hole) relative to the additional resin layer(s) that form(s) the additional net-like section(s) can be easily and reliably set to a predetermined positional relationship by forming the main resin layer and the first additional layer using one photomask. That is, alignment errors between the thin and thick sections of the printed designs can be reliably eliminated. The second additional layer is formed using the first additional layer, which has already been provided on the main mesh, as a guide, and is therefore provided easily and reliably at a predetermined position (i.e. aligned with the first additional layer).

Consequently, in such a screen printing mask, the positional relationship of the main resin layer (through-hole) relative to the additional resin layer can be easily set at a predetermined positional relationship. Furthermore, a (each) thick section can be easily and reliably formed, at a (each) predetermined position, on a (each) portion of the substrate (material to be printed on) that is to be printed thinly.

In another aspect of the present teachings, a screen printing mask may be produced as follows. First, in a first photocurable resin coating step, a first photocurable resin layer is formed by coating a main mesh with a photocurable resin. Then, in a first photomask overlaying step, a first photomask overlaid entity is formed by disposing, on the first photocurable resin layer, a first photomask having one or more light transmission sections corresponding to a structure of a main resin layer. Thereafter, in a first light irradiation step, a main resin layer is formed (latently formed) by irradiating light onto the first photomask overlaid entity from the first photomask side to thereby cure a (each) portion, in the first photocurable resin layer, corresponding to the light transmission section(s) of the first photomask. Next, in a first uncured resin removal step, a main resin layer appears (is revealed) by removing the first photomask from the first photomask overlaid entity, and by removing uncured photocurable resin in the first photocurable resin layer.

Subsequently, in a second photocurable resin coating step, a second photocurable resin layer is formed by coating the main mesh with a photocurable resin at least in one or more through-hole(s) formed in the main resin layer. Then, in a second photomask overlaying step, a second photomask overlaid entity is formed by disposing, on the second photocurable resin layer, a second photomask having one or more light transmission sections corresponding to a structure of one or more additional net-like sections. Thereafter, in a second light irradiation step, the additional net-like section(s) is (are) formed (latently formed) by irradiating light, onto the second photomask overlaid entity from the second photomask side to thereby cure a (each) portion, in the second photocurable resin layer, corresponding to the light transmission section(s) of the second photomask. Finally, in a second uncured resin removal step, the additional net-like section(s) appear(s) (is (are) revealed) by removing the second photomask from the second photomask overlaid entity, and by removing uncured photocurable resin of the second photocurable resin layer. The screen printing mask of the first aspect can be produced easily by utilizing such a method.

In another aspect of the present teachings, a screen printing mask may be produced as follows. First, in a first photocurable resin coating step, a first photocurable resin layer is formed by coating a main mesh with a photocurable resin. Then, in a first photomask overlaying step, a first photomask overlaid entity is formed by disposing, on the first photocurable resin layer, a first photomask having one or more light transmission sections corresponding to a structure of a main resin layer. Next, in a first light irradiation step, a main resin layer is formed (latently formed) by irradiating light onto the first photomask overlaid entity from the first photomask side to thereby cure a (each) portion, in the first photocurable resin layer, corresponding to the light transmission section(s) of the first photomask. Thereafter, in a first photomask removal step, the first photomask is removed from the first photomask overlaid entity.

Subsequently, in a second photocurable resin coating step, a fused (intermixed or combined) photocurable resin layer is formed together with uncured photocurable resin of the first photocurable resin layer, by further coating a (e.g., the same) photocurable resin onto the uncured photocurable resin of the first photocurable resin layer. Next, in a second photomask overlaying step, a second photomask overlaid entity is formed by disposing, on the fused photocurable resin layer, a second photomask having one or more light transmission sections corresponding to a (each) structure of one or more additional net-like sections. Then, in a second light irradiation step, one or more additional net-like sections is (are) formed (latently formed) by irradiating light onto the second photomask overlaid entity from the second photomask side to thereby cure a (each) portion, in the fused photocurable resin layer, corresponding to the light transmission section(s) of the second photomask. Finally, in an uncured resin removal step, the additional net-like section(s) appear(s) (is (are) revealed) by removing the second photomask from the second photomask overlaid entity, and by removing uncured photocurable resin of the fused photocurable resin layer. The screen printing mask of the first aspect can also be produced easily by utilizing such a method.

In another aspect of the present teachings, a screen printing mask may be produced as follows. First, in a first photocurable resin coating step, a first photocurable resin layer is formed by coating a main mesh with a photocurable resin. Next, in a first photomask overlaying step, a first photomask overlaid entity is formed by disposing, on the first photocurable resin layer, a first photomask having light transmission sections corresponding to a structure of a main resin layer and one or more first additional layers to form one or more foundations for one or more additional net-like sections. Then, in a first light irradiation step, the main resin layer and the first additional layer(s) are formed (latently formed) by irradiating light onto the first photomask overlaid entity from the first photomask side to thereby cure the portions, in the first photocurable resin layer, corresponding to the light transmission sections of the first photomask. Subsequently, in a first uncured resin removal step, the main resin layer and the first additional layer(s) appear (are revealed) by removing the first photomask from the first photomask overlaid entity, and by removing uncured photocurable resin in the first photocurable resin layer.

Next, in a second photocurable resin coating step, a second photocurable resin layer is formed by coating the first additional layer with a (e.g., the same) photocurable resin. Thereafter, in a second photomask overlaying step, a second photomask overlaid entity is formed by disposing, on the second photocurable resin layer, a second photomask having one or more light transmission sections corresponding to one or more structures of one or more second additional layers that will be cross-linked (bound) to the first additional layer(s) to form the additional net-like section(s). Further, in a second light irradiation step, the second additional layer(s) is (are) formed (latently formed) by irradiating light onto the second photomask overlaid entity from the second photomask side to thereby cure a (each) portion, in the second photocurable resin layer, corresponding to the light transmission section(s) of the second photomask. Finally, in a second uncured resin removal step, the second additional layer(s) appear(s) (is (are) revealed) by removing the second photomask from the second photomask overlaid entity, and by removing uncured photocurable resin of the second photocurable resin layer. The screen printing mask of the second aspect can be produced by utilizing such a method.

In another aspect of the present teachings, a screen printing mask may be produced as follows. First, in a first photocurable resin coating step, a first photocurable resin layer is formed by coating a main mesh with a photocurable resin. Then, in a first photomask overlaying step, a first photomask overlaid entity is formed by disposing, on the first photocurable resin layer, a first photomask having light transmission sections corresponding to a structure of a main resin layer and of one or more first additional layers to form one or more foundations for one or more additional net-like sections. Next, in a first light irradiation step, the main resin layer and the first additional layer(s) are formed (latently formed) by irradiating light onto the first photomask overlaid entity from the first photomask side to thereby cure the portions, in the first photocurable resin layer, corresponding to the light transmission sections of the first photomask. Subsequently, in a first photomask removal step, the first photomask is removed from the first photomask overlaid entity.

Then, in a second photocurable resin coating step, a fused (intermixed or combined) photocurable resin layer is formed together with uncured photocurable resin of the first photocurable resin layer by coating the first additional layer(s) with a (e.g., the same) photocurable resin. Thereafter, in a second photomask overlaying step, a second photomask overlaid entity is formed by disposing, on the fused photocurable resin layer, a second photomask having one or more light transmission sections corresponding to one or more structures of one or more second additional layers that will be cross-linked to the first additional layer(s) to form the additional net-like section(s). Next, in a second light irradiation step, the second additional layer(s) is (are) formed (latently formed) by irradiating light onto the second photomask overlaid entity from the second photomask side to thereby cure a (each) portion, in the fused photocurable resin layer, corresponding to the light transmission section(s) of the second photomask. Finally, in an uncured resin removal step, the second additional layer(s) appear(s) (is (are) revealed) by removing the second photomask from the second photomask overlaid entity, and by removing uncured photocurable resin of the fused photocurable resin layer. The screen printing mask of the second aspect can also be produced by utilizing such a method.

In another aspect of the present teachings, in the screen printing masks of the first and second aspects, the additional net-like section(s) is (are) provided on the main mesh by forming a plurality of interconnected resin pieces that are substantially perpendicular to the main mesh.

The term "substantially perpendicular" encompasses "perpendicular". The same definition also applies to other aspects of the present teachings.

In this aspect of the present teachings, the resin pieces are more reliably prevented from coming off the main mesh, as compared with embodiments in which the resin pieces are provided individually or separately on the main mesh. The screen printing mask can thus be used over long periods of time, i.e. it is more durable.

Such a screen printing mask may be modified as follows.

The (each) first additional layer may be provided on the main mesh by forming a plurality of mutually connected first layer resin pieces that are (extend) substantially perpendicular to the main mesh.

Furthermore, the (each) second additional layer may be provided on the (each) first additional layer by forming a plurality of mutually connected second layer resin pieces that are (extend) substantially perpendicular to the main mesh.

In such a modified screen printing mask as well, the first layer resin pieces are more reliably prevented from coming off the main mesh, as compared with embodiments in which the first layer resin pieces are provided individually or separately on the main mesh. The screen printing mask can thus be used over longer periods of time, i.e. it is more durable.

In another aspect of the present teachings, in the screen printing masks of the first and second aspects, the additional net-like section(s) has (have) a honeycomb shape.

Because the additional net-like section of this embodiment has a honeycomb shape, the screen printing mask exhibits higher strength and durability, and can be used over yet longer periods of time.

Further objects, embodiments, advantages and effects of the present teachings will become apparent upon reading the following detailed description, together with drawings showing exemplary embodiments of the present teachings.

BRIEF DESCRIPTION OF THE DRAWINGS

FIGS. 8B and 8C are diagrams illustrating a front glass (windshield) of an automobile, which is another example of a material (substrate) that can be printed on using a printing mask of the present teachings, wherein FIG. 8B is a diagram illustrating the greater part of the front glass, and FIG. 8C is a diagram illustrating an enlarged part thereof;

DETAILED DESCRIPTION OF THE PREFERRED EMBODIMENTS

Embodiment 1A

Embodiment 1A of the present teachings will first be explained with reference to FIG. 1 to FIG. 8C.

Figure 8A:
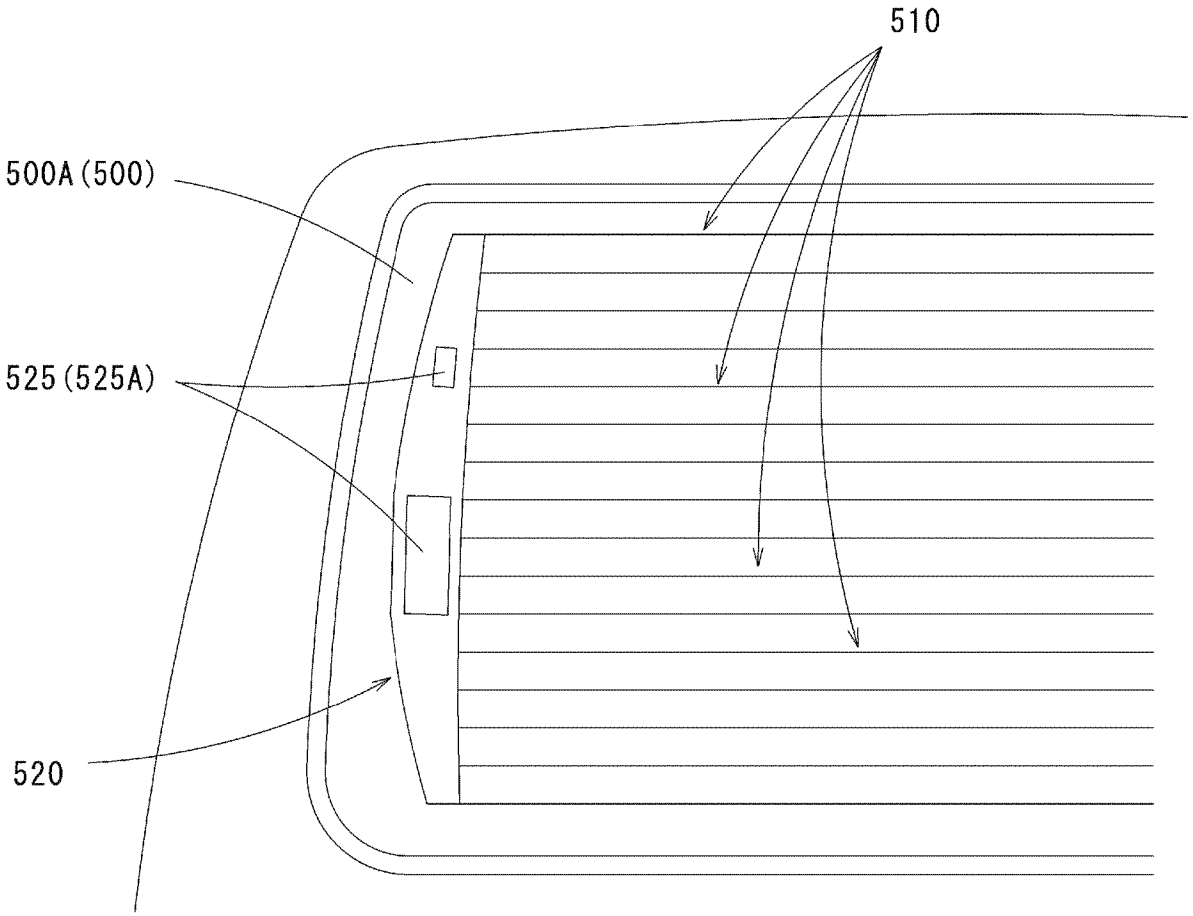
FIG. 8A is a diagram illustrating a rear glass (windshield) of an automobile, which is an example of a material (substrate) that can be printed on using a printing mask of the present teachings.

The screen printing mask (also simply referred to as "printing mask") 10 shown in FIG. 1 to FIG. 4 may be used (designed), e.g., to dispose or deposit (screen print) one or more heating wires (electrically-conductive elements) 510 or the like for preventing or clearing fogging (condensation) on a rear glass (rear window or windshield) 500A (500) (FIG. 8A) of an automobile, as was mentioned above. Such a device is also known as a rear defroster. For example, as illustrated in FIG. 8A, printing masks 10 according to the present teachings may be designed to dispose (screen print) a pair of bus bars 520 (only one shown in FIG. 8A) that extend in the vertical direction on the left and right sides of the rear glass 500A, and to dispose (screen print) a plurality of (e.g., parallel) heating wires 510 that extend in the transverse direction (horizontal direction) between the two bus bars 520 and are electrically connected thereto. One or more portions of each bus bar 520 include a thick section 525A (525) that is thicker than other portions of the bus bar 520.

Figure 8B:
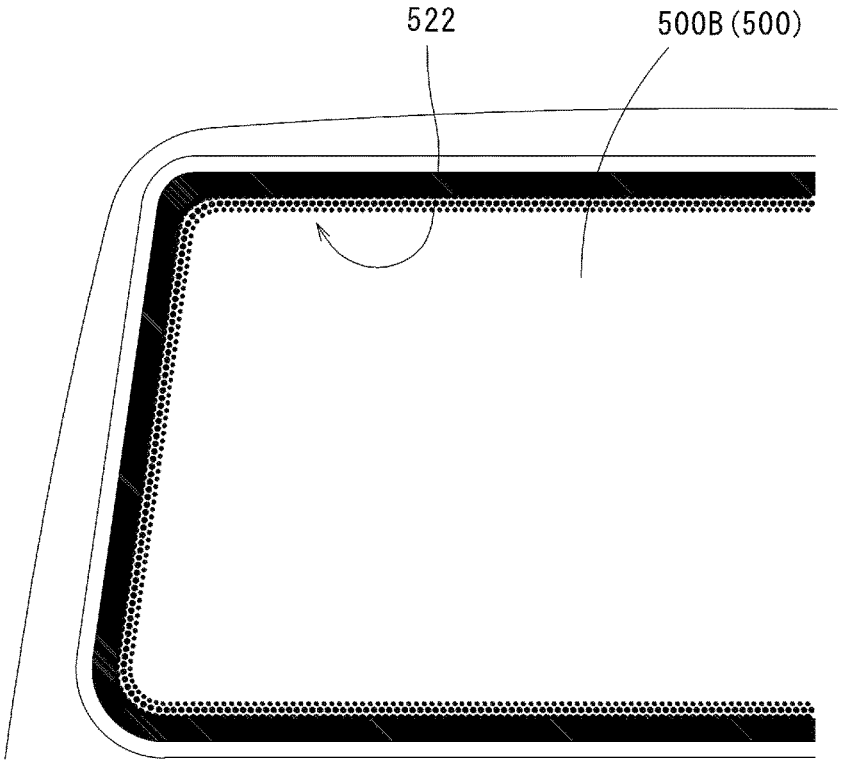
Figure 8C:
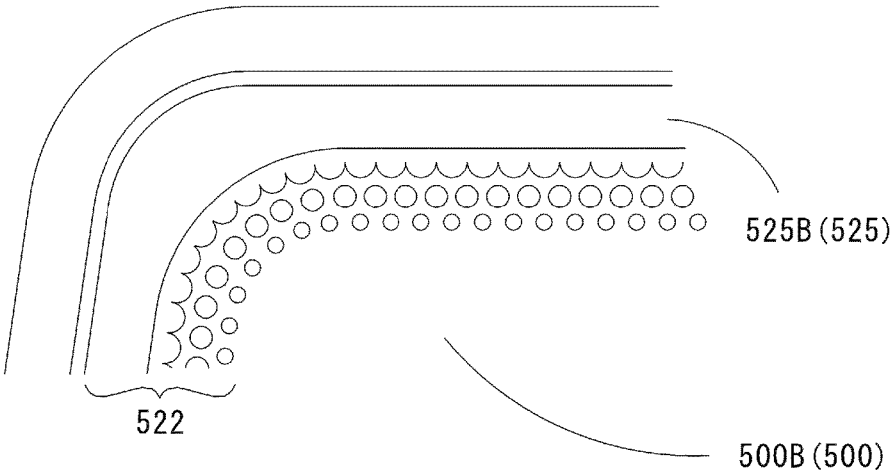

In addition, printing masks 10 according to the present teachings also (instead) may be used (designed) to form, for instance, a border (e.g., an opaque enamel band) 522 on a front glass (front window or windshield) 500B (500) (FIG. 8B) of an automobile by screen printing in the same way as described above. For example, the border 522 may be formed, using a black ceramic ink, along or around the peripheral edge of the front glass 500B, as illustrated in FIGS. 8B and 8C (the border 522 in FIG. 8B is depicted as a wide black line). The main portion of the border 522 is entirely filled in with the ceramic ink (i.e. it is a continuous black ink/enamel band that has no holes or transparent regions), and a pattern comprised of multiple dots (i.e. a dot matrix) extends along or around the inner edge of the opaque band.

The filled-in portion (opaque band) is printed thickly with a rough surface to promote adhesion (this portion will be referred to herein as thick section 525B (525)), whereas other portions, e.g., the dot matrix, are printed thinly and finely (precisely). The dot matrix is designed to permit some light to pass through it and is provided to improve the aesthetic appearance and/or for shading purposes.

As illustrated in FIG. 1 to FIG. 4, the printing mask 10 comprises a main mesh (screen) 20, a main resin layer (stencil) 30 and one or more additional net-like sections (hollow cells) 50A. The thickness of the printing mask 10 (including the thickness of the various elements thereof) depicted in the figures has been exaggerated to aid the following explanation. The gaps or spacings between the fibers, threads or wires of the main mesh 20 have also been exaggerated to clarify the role of the main mesh 20 as a liquid-permeable material.

The main mesh 20 is attached to a frame 25 (FIG. 1 to FIG. 3), which may be, e.g., quadrangular, although the shape of the frame is not particularly limited in the present teachings. The main mesh 20 (FIG. 1 to FIG. 4) is formed of a material having sufficient stiffness, for instance a synthetic resin, metal or the like, and has multiple minute openings (gaps or spacings). The main mesh 20 may thus be comprised, e.g., of a woven fabric, metal wire screen, etc. and the thickness of the main mesh 20 may be, for instance, 60 μm. Herein, the thickness direction is understood as being perpendicular to the plane of the main mesh 20 or the main resin layer 30.

The main resin layer 30 is attached (adhered, affixed, bound) to the lower face of the main mesh 20 (the lower face as defined in the state in which the printing mask 10 is being used to print a pattern on a substrate). The main resin layer 30 may be formed, e.g., from a photocurable resin and constitutes a stencil (blocking stencil), i.e. a liquid-impermeable layer that blocks ink (liquid) from passing through the main mesh 20 to the substrate (material to be printed on) during the screen printing operation. For example, the main resin layer 30 may be formed by curing an emulsion (a photo emulsion) of an (uncured) photocurable resin, by irradiating it with (exposing it to) a light source, such as ultraviolet light. The main resin layer 30 may be one continuous layer or may be two or more discontinuous (discrete) layers that are located in the same plane.

One or more through-holes (opening(s) or open space(s)) 35 is/are formed in the main resin layer 30 as a result of the photo emulsion process. The through-hole(s) 35 is (are) formed so as to correspond to the bus bars 520 and heating wires 510 (FIG. 8A) or to the border 522 (FIGS. 8B and 8C) described above. Thus, within the main resin layer 30, portions other than the through-hole(s) 35 block the passage of ink (liquid) through the main mesh 20. The thickness of the main resin layer 30 (other than the through-hole(s) 35) is, for instance, 6 μm.

One or more additional net-like sections 50A is (are) provided, on the main mesh 20, at one or more locations within the through-hole(s) 35 of the main resin layer 30. The additional net-like section(s) 50A is (are) formed and located so as to correspond to (thereby form) the thick section(s) 525A in the bus bars 520 (FIG. 8A), or the thick section(s) 525B (FIG. 8C) in the border 522 (FIGS. 8B and 8C) described above.

Figure 1:
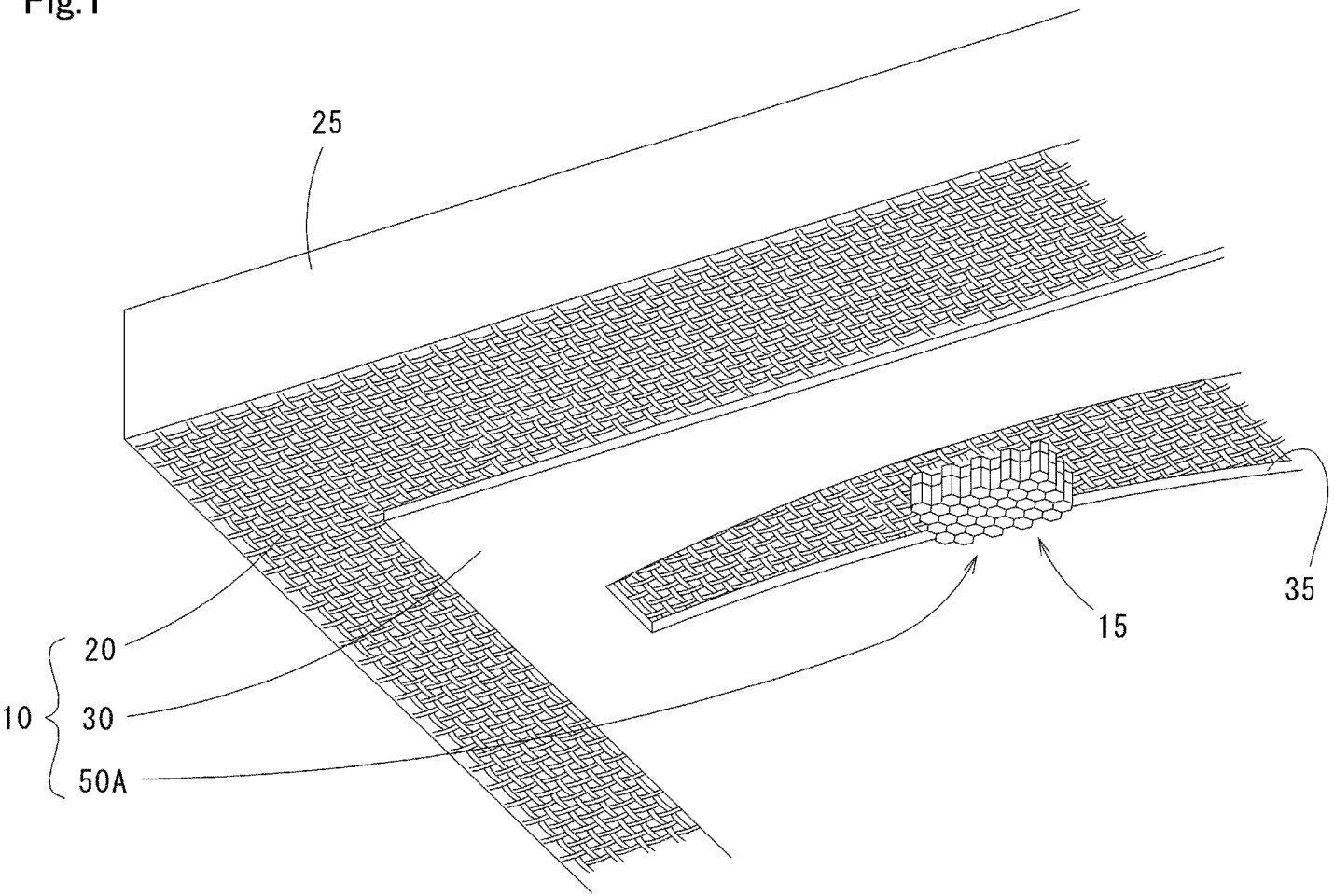
FIG. 1 is a perspective-view diagram illustrating, obliquely from below, a screen printing mask (hereinafter, simply "printing mask") of Embodiment 1A of the present teachings.
Figure 2:
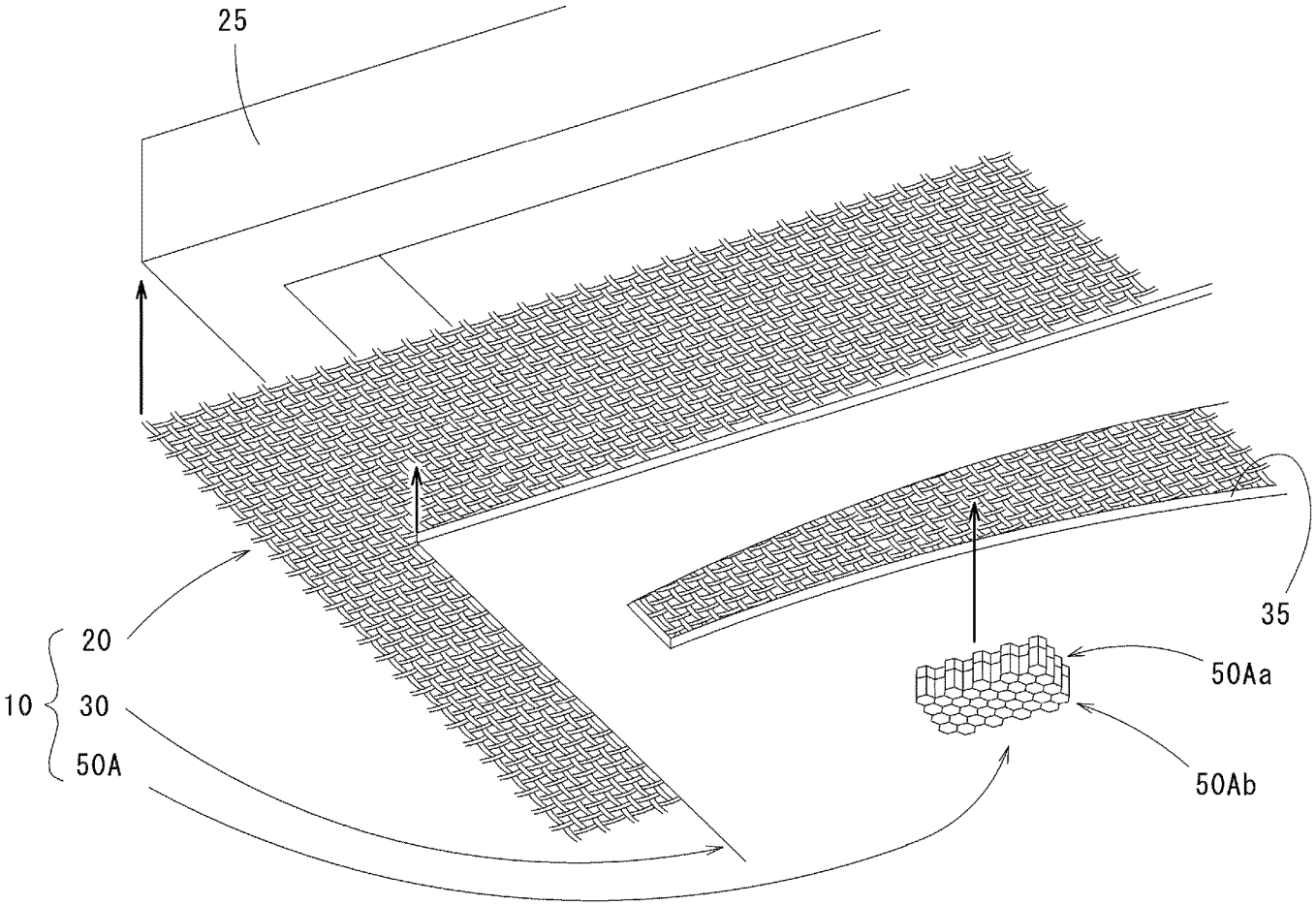
FIG. 2 is an exploded perspective-view diagram illustrating, obliquely from below, the printing mask of Embodiment 1A.
Figure 3:
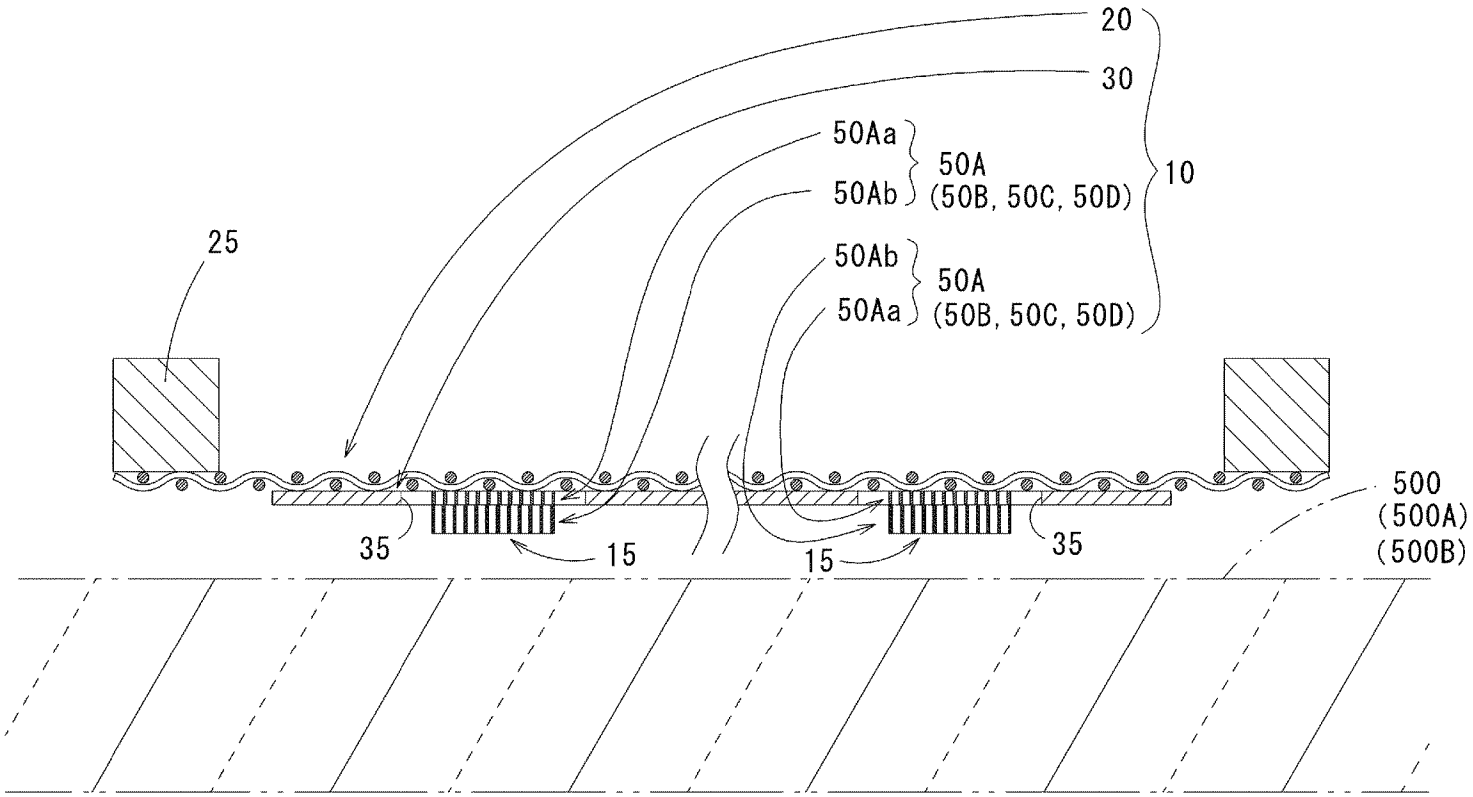
FIG. 3 is a longitudinal cross-sectional diagram illustrating the printing mask of Embodiment 1A.

The portion(s) at which the additional net-like section(s) 50A is (are) provided on the main mesh 20, i.e. the portion(s) at which the additional net-like section(s) 50A is (are) superimposed on (overlap) the main mesh 20, will also be referred to as thick mesh section(s) 15 (FIG. 1, FIG. 3).

As utilized herein, the term "additional net-like section" is intended to encompass structures having a lattice, network or grid structure that defines a plurality of hollow cells or columns, which are interconnected and/or share common vertical walls (i.e. walls that extend perpendicular to the plane of the main mesh 20 and the main resin layer 30). In other words, a plurality of interconnected vertical walls defines a plurality of hollow or open compartments for ink to pass through to the substrate to be printed on. The interconnected vertical walls typically exhibit polygonal shapes in horizontal cross-section, preferably regular or repeating polygonal shapes, although irregular and/or non-repeating hollow cell structures may be utilized. In other words, the net-like section(s) may be an array, grid, network, lattice or repeating structure of hollow cells wherein the vertical walls have a length (depth of the net-like section) that is greater than the thickness of the vertical walls in the horizontal cross-section (i.e. the direction parallel to the plane of the main mesh 20 and the main resin layer 30). In the horizontal cross-section through the net-like section, the through-holes or open spaces may comprise, e.g., at least 50% of the total area of the net-like section, i.e. the vertical walls comprise less than 50% of this surface area. More preferably, the through-holes or open spaces comprise at least 60% or at least 70% of the total surface area. However, variations of these structures are permissible as long as the (each) net-like section 50A is ink-permeable (i.e. it permits ink to pass through the main mesh 20 to the substrate) and the (each) net-like section 50A has a greater thickness than the main resin layer 30. Preferably, the (each) net-like section 50A is not compressible, or is not significantly compressible, when pressed during a screen printing operation. Furthermore, during the screen printing operation, the (each) net-like section 50A preferably spaces the main mesh 20 farther away from the substrate when pressed, e.g., by a squeegee or floodbar, than the main resin layer 30.

The (each) additional net-like section 50A (FIG. 1 to FIG. 4) also may be formed from a photocurable resin (photo emulsion), which is the same as the photocurable resin utilized to form the main resin layer 30 in the present embodiment. However, in other embodiments, the (each) additional net-like section 50A may optionally be formed from a different photocurable resin than the main resin layer 30.

In Embodiment 1A, the (each) additional net-like section 50A is formed by a first additional layer 50Aa and a second additional layer 50Ab, which is superimposed on and fused with (e.g., covalently bound to) the first additional layer 50Aa. The thickness of the first additional layer 50Aa (i.e. the length of the vertical walls in the depth direction) is, for instance, 6 μm, which is the same as or similar to the thickness of the main resin layer 30 (other than the through-hole(s) 35). The thickness of the second additional layer 50Ab (i.e. the length of the vertical walls in the depth direction) is, for instance, 60 μm. Accordingly, the combined thickness of the additional net-like section 50A is for instance 66 μm.

Thus, in the printing mask 10, the thickness (mesh thickness) of the main mesh 20 is for instance 60 μm, as described above, while the overall thickness (mesh thickness) of the thick mesh section 15 is for instance: 60 μm (thickness of the main mesh 20)+66 μm (thickness of the additional net-like section 50A)=126 μm.

The first and second additional layers 50Aa and 50Ab preferably comprise the same chemical composition and are covalently bound together by direct cross-linking, i.e. without the use of any additional adhesive having a different chemical composition.

Figure 4:
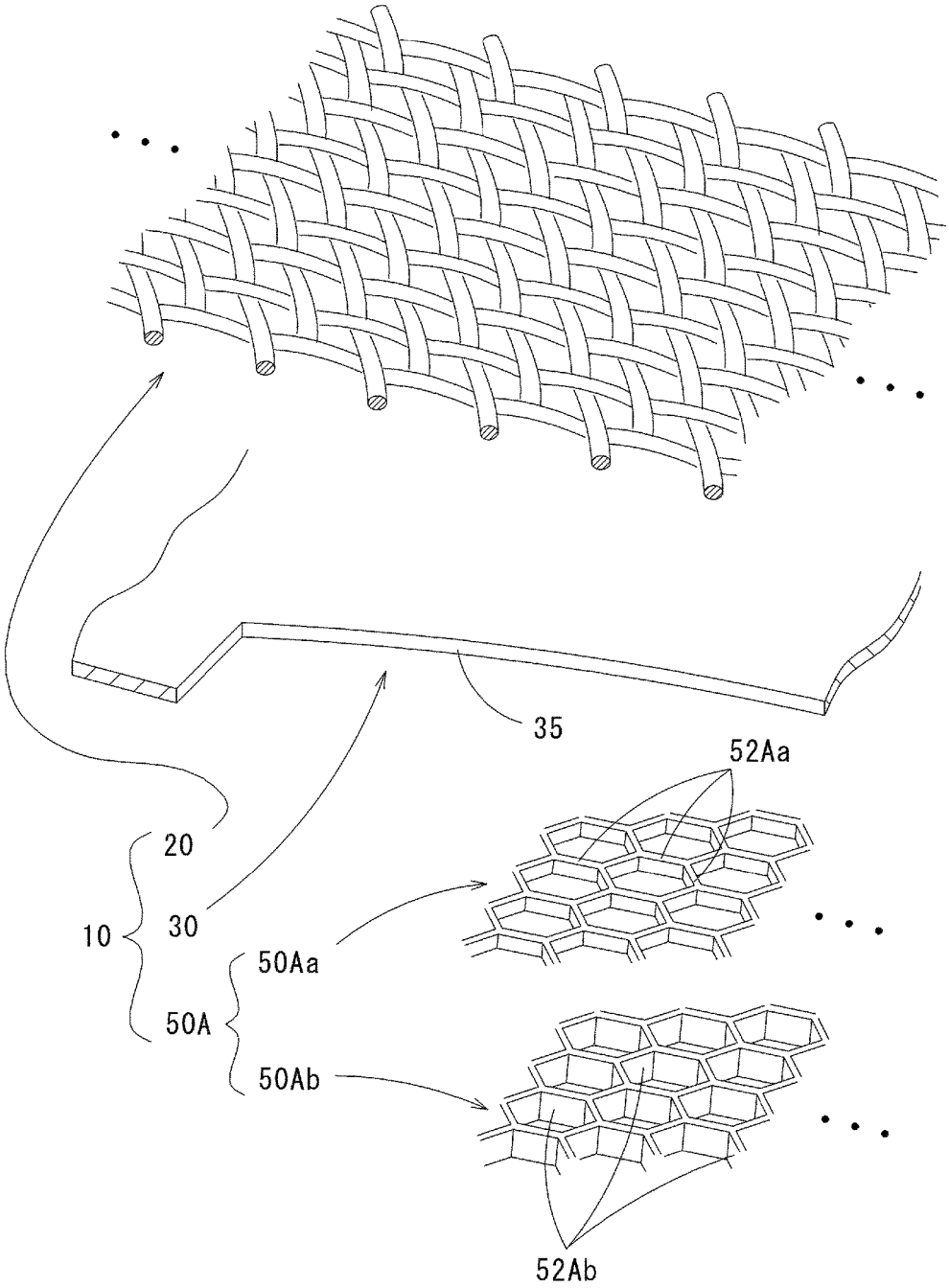
FIG. 4 is an exploded perspective-view diagram illustrating, obliquely from above, an enlarged portion of the printing mask of Embodiment 1A.

The hollow cell structure of a first representative additional net-like section 50A will be now explained in greater detail. As illustrated in FIG. 4, the first additional layer 50Aa and the second additional layer 50Ab have a honeycomb shape, i.e. a network, lattice or grid of hollow regular hexagonal shapes (columns) (substantially regular hexagonal shapes/columns).

To form the network of regular hexagonal shapes in the first additional layer 50Aa, multiple first layer resin pieces (vertical walls) 52Aa that form the respective sides of regular hexagonal shapes are vertically erected on the main mesh 20, such that adjacent first layer resin pieces 52Aa are interconnected. In the second additional layer 50Ab as well, multiple second layer resin pieces (vertical walls) 52Ab that form the respective sides of the regular hexagonal shapes are similarly erected, on the first additional layer 50Aa, perpendicularly to the main mesh 20, so that adjacent second layer resin pieces 52Ab are interconnected to each other and to the adjacent (underlying) first layer resin pieces 52Aa.

The height of the first layer resin pieces 52Aa in the first additional layer 50Aa is the thickness of the first additional layer 50Aa, and is for instance 6 μm, as described above. The height of the second layer resin pieces 52Ab in the second additional layer 50Ab is the thickness of the second additional layer 50Ab, and is for instance 60 μm, as described above.

The additional net-like section(s) 50A may have a configuration in which the network of the regular hexagonal shapes of the first additional layer 50Aa and the network of the regular hexagonal shapes of the second additional layer 50Ab match (coincide with) each other, or a configuration in which the hollow cells of the layers 50Aa, 50Ab are offset from each other. The overall size (area) of the network of the first additional layer 50Aa (the overall size (area) of the regular hexagonal shapes) may be the same as or different than the overall size (area) of the network of the second additional layer 50Ab (the overall size (area) of the regular hexagonal shapes).

Figure 5A:
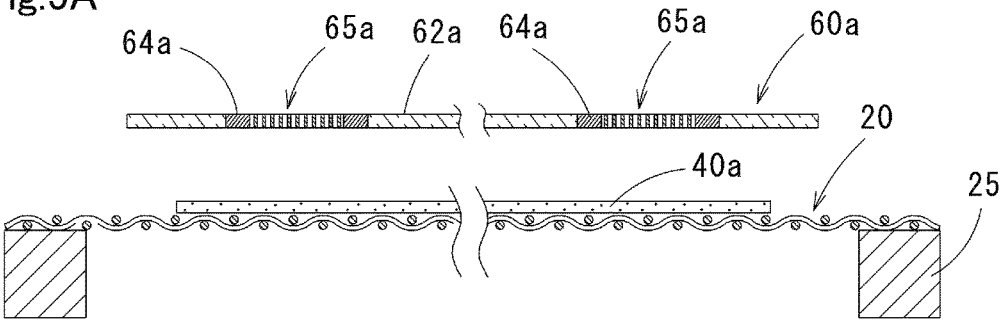
FIG. 5A is a longitudinal cross-sectional diagram illustrating a manufacturing process (initial step thereof) according to a first manufacturing method of the printing mask of Embodiment 1A.

A first method for manufacturing the printing mask 10 of Embodiment A1 will be explained in the following with reference to FIG. 5A to FIG. 5H. The main mesh 20 is prepared first, as illustrated in FIG. 5A. The main mesh 20 is attached to the frame 25. In the manufacturing process of the printing mask 10 depicted in FIG. 5A to FIG. 5H, the printing mask 10 (FIG. 5H) and the manufacturing intermediates thereof (FIG. 5A to FIG. 5G) are in a state vertically reversed with respect to the state in which the printing mask will be used during a screen printing operation.

As illustrated in FIG. 5A, the top face (lower face while in use) of the main mesh 20 is coated with an emulsion of a photocurable resin, i.e. a photo emulsion, thereby forming a first photocurable resin layer 40*a*. This step will be referred to as a first photocurable resin coating step.

As used herein, the term "photocurable resin" is intended to encompass polymer preparations that change their properties when exposed to light, such as ultraviolet light or visible light. Typically, the change of properties results from cross-linking that causes a liquid polymer material to change into a solidified polymer layer that is affixed, adhered, bound, and/or cross-linked to the mesh 20.

Representative, non-limiting examples of polymers that may be cross-linked according to the present teachings are vinyl polymers (vinyl resins), such as polyvinyl acetate and polyvinyl alcohol. Of course, other types of cross-linking polymers may be advantageously utilized with the present teachings, as appropriate.

A sensitizer or initiator may be added to the polymer solution, e.g., to form an emulsion, in order to effect the cross-linking. For example, the sensitizer or initiator may react to (e.g. absorb) the light (e.g., UV light) and either catalyze the cross-linking or be incorporated into the cross-linked structure. Diazo compounds are often used in photo emulsions for this purpose.

Photopolymers may also be used that directly absorb light to undergo cross-linking. For example, a polyvinyl alcohol having a grafted photosensitive group may be utilized in the present teachings.

Thus, the main resin layer (stencil) 30 and the net-like section(s) 50A may be comprised of a cross-linked polymer (cross-linked resin), e.g., a cross-linked vinyl polymer (resin).

Figure 5B:
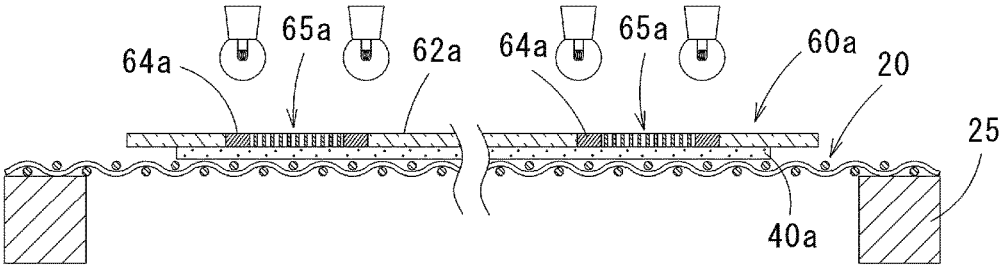
FIG. 5B is a longitudinal cross-sectional diagram illustrating a manufacturing process (step following that of FIG. 5A) according to the first manufacturing method of the printing mask of Embodiment 1A.

Next, as illustrated in FIG. 5A and FIG. 5B, a first photomask (overlay) 60*a* is placed (disposed) on the first photocurable resin layer 40*a*. A first photomask overlaid entity (reference number omitted) is thus formed and comprises the first photomask 60*a*, the resin 40*a* and the main mesh 20. This step will be referred to as a first photomask overlaying step.

Figure 5C:
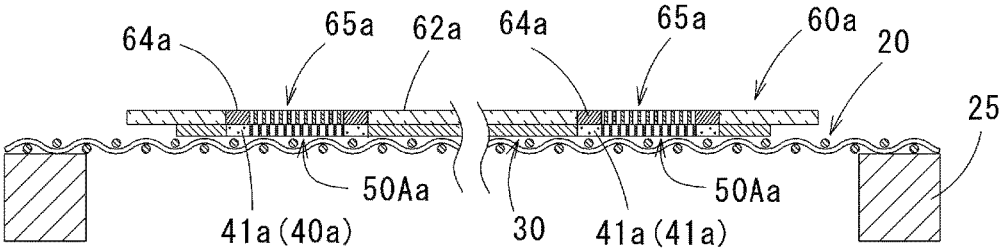
FIG. 5C is a longitudinal cross-sectional diagram illustrating a manufacturing process (step following that of FIG. 5B) according to the first manufacturing method of the printing mask of Embodiment 1A.
Figure 5D:
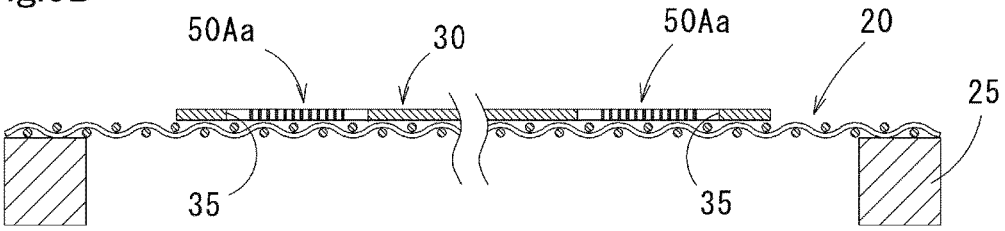
FIG. 5D is a longitudinal cross-sectional diagram illustrating a manufacturing process (step following that of FIG. 5C) according to the first manufacturing method of the printing mask of Embodiment 1A.

The image on the first photomask 60*a* corresponds to the structure (design) of the main resin layer 30 and the first additional layer(s) 50Aa of the additional net-like section(s) 50A (FIG. 3, FIG. 5D). That is, the first photomask 60*a* contains a negative image of the pattern (e.g., conductive heating elements or a border (frit)) to be printed on the substrate (e.g., a windshield).

More specifically, within the first photomask 60*a*, the portion(s) that correspond(s) to the through-hole(s) (open space(s)) 35 (FIGS. 1-3, FIG. 5D) of the main resin layer 30, is (are), in principle, light transmission blocking (light impermeable) section(s) 64*a*, and the portion(s) corresponding to the portion(s) other than the through-hole(s) 35 of the main resin layer 30 is (are) light transmission section(s) 62*a* (i.e. transparent or light permeable).

Within the first photomask 60*a*, the portion(s) that correspond(s) to the first additional layer(s) 50Aa in the additional net-like section(s) 50A, which are located within the through-hole(s) 35 (FIGS. 1-3, FIG. 5D) of the main resin layer 30, is (are) first additional layer negative corresponding section(s) 65*a*. That is, the portions corresponding to the first layer resin pieces 52Aa (FIG. 4) of the first additional layer 50Aa, in the first additional layer negative corresponding section 65*a*, are also light transmission (permeable) sections (reference number omitted), and the remaining portions are light transmission blocking (light impermeable) sections (reference number omitted).

As illustrated in FIG. 5B, light (e.g., ultraviolet light) is then irradiated, from the side of the first photomask 60*a*, onto the first photomask overlaid entity. This step will be referred to as a first light irradiation step. The light passes through the light transmission section(s) 62*a* in the first photomask 60*a* and through the light transmission section(s) of the first additional layer negative corresponding section(s) 65*a*, and reaches the portions, in the first photocurable resin layer 40*a*, underneath (corresponding to) the light transmission section(s) 62*a* and the first additional layer negative corresponding section(s) 65*a*. As illustrated in FIG. 5C, the irradiated portions cure (e.g., cross-link) and become solidly affixed (bound) to the main mesh 20. The main resin layer 30 and the first additional layer(s) 50Aa of the additional net-like section(s) 50A are thus formed (latently formed). The main resin layer 30 and the first additional layer(s) 50Aa of the additional net-like section(s) 50A are thereby provided (firmly attached) on the main mesh 20. On the other hand, no light reaches the portions, in the first photocurable resin layer 40*a*, corresponding to (underneath) the light transmission blocking section(s) 64*a* of the first photomask 60*a* and the light transmission blocking section(s) of the first additional layer negative corresponding section(s) 65*a*, and such non-irradiated resin undergoes no curing. This photocurable resin, which remains in the liquid state, will be referred to as uncured resin 41*a*.

Then, the first photomask 60*a* is removed from the above-described first photomask overlaid entity, to yield a first photomask-removed entity (not shown). The uncured (liquid) resin 41*a* is removed, for instance, by immersing the first photomask-removed body in water or another solvent or by spraying the first photomask-removed body with water or another solvent. The main resin layer 30 having the through-hole(s) 35 thus appears (is revealed), as illustrated in FIG. 5D. The first additional layer(s) 50Aa of the additional net-like section(s) 50A in the through-hole(s) 35 also appear(s) (is (are) revealed) at the same time. This step will be referred to as a first uncured resin removal step.

Figure 5E:
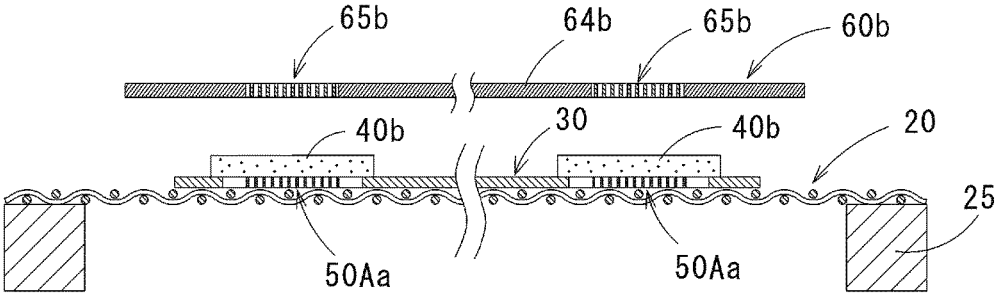
FIG. 5E is a longitudinal cross-sectional diagram illustrating a manufacturing process (step following that of FIG. 5D) according to the first manufacturing method of the printing mask of Embodiment 1A.

Thereafter, each first additional layer 50Aa (including, in some instances, a peripheral portion thereof) is coated with an emulsion of a photocurable resin, as illustrated in FIG. 5E, which may be the same as or different from the photocurable resin utilized in the first photocurable resin coating step. Respective second photocurable resin layers 40*b* are thus formed. This step will be referred to as a second photocurable resin coating step.

Figure 5F:
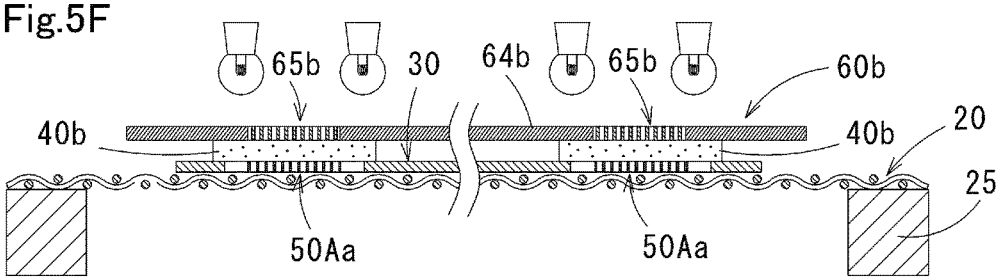
FIG. 5F is a longitudinal cross-sectional diagram illustrating a manufacturing process (step following that of FIG. 5E) according to the first manufacturing method of the printing mask of Embodiment 1A.

Next, as illustrated in FIG. 5E and FIG. 5F, a second photomask (overlay) 60*b* is placed (disposed) on the second photocurable resin layers 40*b*. A second photomask overlaid entity (reference number omitted) is thus formed and comprises the second photomask 60*b*, the resin 40*b*, the main resin layer 30, the first additional layer(s) 50Aa and the main mesh 20. This step will be referred to as a second photomask overlaying step.

Figure 5G:
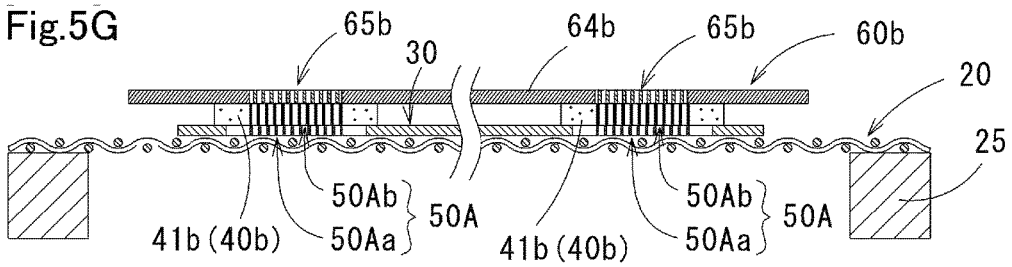
FIG. 5G is a longitudinal cross-sectional diagram illustrating a manufacturing process (step following that of FIG. 5F) according to the first manufacturing method of the printing mask of Embodiment 1A.

As illustrated in FIG. 5E to FIG. 5G, a single second photomask 60*b* may be prepared and disposed so as to correspond to (cover) all the second photocurable resin layers 40*b*. However, it is also possible to prepare and dispose a plurality of second photomasks (60*b*), not shown, corresponding to (respectively covering) the second photocurable resin layers 40*b*.

The image on the second photomask 60*b* corresponds to the structure (design) of the second additional layer(s) 50Ab (FIGS. 1-3, FIG. 5H) of the additional net-like section(s) 50A. That is, the second photomask 60*b* contains a negative image of the second additional layer(s) 50Ab to be (respectively) disposed or deposited on top of the first additional layer(s) 50Aa. More specifically, within the second photomask 60*b*, the portion(s) corresponding to the second additional layer(s) 50Ab (FIG. 3, FIG. 5H) of the additional net-like section(s) 50A is (are) second additional layer negative corresponding section(s) 65*b*, and the remaining portion(s) is (are) light transmission blocking section(s) 64*b*. In the second additional layer negative corresponding section(s) 65*b*, the portions corresponding to the second layer resin pieces 52Ab (FIG. 4) of the second additional layer 50Ab are light transmission sections (reference number omitted), and the remaining portions are light transmission blocking (light impermeable) sections (reference number omitted).

Light (e.g., ultraviolet light) is then irradiated again, from the side of the second photomask 60*b*, onto the second photomask overlaid entity, as illustrated in FIG. 5F. This step will be referred to as a second light irradiation step. The light passes through the light transmission section(s) (reference number omitted) in the second photomask 60*b* (i.e. through the second additional layer negative corresponding section(s) 65*b*), and reaches the portion(s), in the second photocurable resin layers 40*b*, underneath (corresponding to) the light transmission section(s) thereof. As illustrated in FIG. 5G, the irradiated portions cure and become solidly affixed to the first additional layer(s) 50Aa. The second additional layer(s) 50Ab is (are) thus formed (latently formed). The second additional layer(s) 50Ab is (are) thereby (respectively) provided on the first additional layer(s) 50Aa. The additional net-like section(s) 50A is (are) formed as a result. On the other hand, no light reaches the portions, in the second photocurable resin layer 40*b*, underneath (corresponding to) the light transmission blocking section(s) 64*b* of the second photomask 60*b* and the light transmission blocking section(s) of the second additional layer negative corresponding section(s) 65), such that non-irradiated resin undergoes no curing. This photocurable (still liquid) resin will be referred to as uncured resin 41*b*.

Figure 5H:
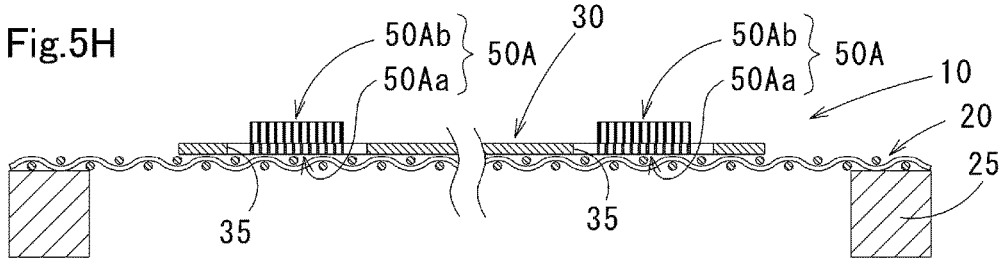
FIG. 5H is a longitudinal cross-sectional diagram illustrating a manufacturing process (step following that of FIG. 5G) according to the first manufacturing method of the printing mask of Embodiment 1A.

The second photomask 60*b* is then removed from the above-described second photomask overlaid entity, to yield a second photomask-removed entity (not shown). The uncured resin 41*b* is removed again as was described above, for instance, by immersing or spraying the second photomask-removed body in (with) water or another solvent. The second additional layer(s) 50Ab appear(s) (is (are) revealed) over (under, when in use) the first additional layer(s) 50Aa, as illustrated in FIG. 5H. The additional net-like section(s) 50A thus appear(s) (is (are) revealed). This step will be referred to as a second uncured resin removal step. Thus, the printing mask 10 of Embodiment 1A is produced.

A second method for manufacturing the printing mask 10 will be now explained with reference to FIG. 6A to FIG. 6H. The second manufacturing method is appropriate, e.g., for a configuration (design) in which the overall size (area) of the network(s) of the first additional layer(s) 50Aa (the overall size (area) of the regular hexagonal shapes) is identical to the overall size (area) of the network(s) of the second additional layer(s) 50Ab (the overall size (area) of the regular hexagonal shapes), in the additional net-like section(s) 50A (FIG. 4), and the network of the first additional layer 50Aa matches (coincides with) the network of the second additional layer 50Ab.

In summary, the second manufacturing method differs from the first manufacturing method only in that the first uncured resin removal step is omitted. That is, when the first photomask 60*a* is removed after the first light irradiation step, additional photocurable resin 41*a* is disposed on the first additional layer(s) 50Aa without removing the photocurable resin 41*a* that remains uncured after the first light irradiation step. Otherwise, the first and second manufacturing methods may be identical, as will become apparent from the following description of the second manufacturing method.

Figure 6A:
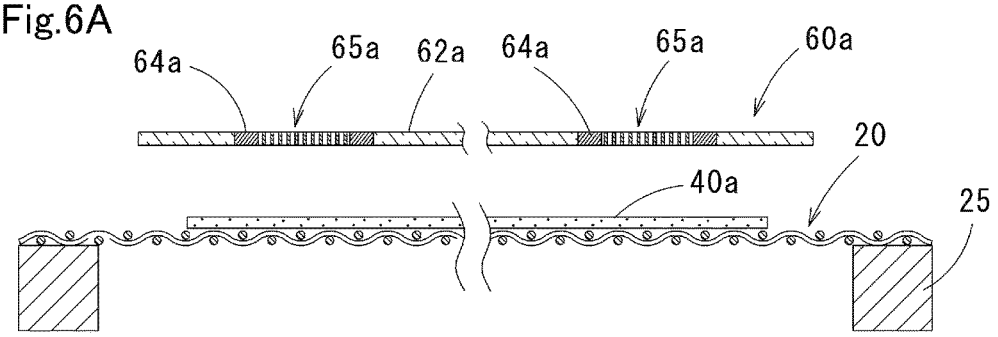
FIG. 6A is a longitudinal cross-sectional diagram illustrating a manufacturing process (initial step thereof) according to a second manufacturing method of the printing mask of Embodiment 1A.

Similar to the first manufacturing method, the main mesh 20 is prepared first, as illustrated in FIG. 6A and is attached to the frame 25. In the manufacturing process of the printing mask 10 (FIG. 6A to FIG. 6H), the printing mask 10 (FIG. 6H) and the manufacturing intermediates thereof (FIG. 6A to FIG. 6G) are again in a state vertically reversed with respect to the state in which the printing mask will be used during a screen printing operation.

As illustrated in FIG. 6A, the top face (lower face while in use) of the main mesh 20 is coated with an emulsion of a photocurable resin, as was described above in greater detail. The first photocurable resin layer 40*a* is thus formed. This step will again be referred to as the first photocurable resin coating step.

Figure 6B:
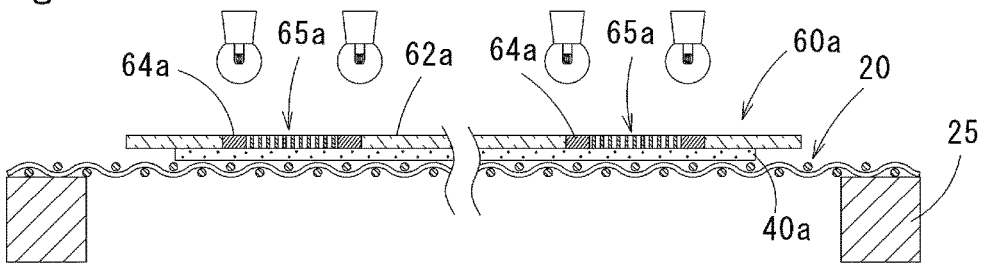
FIG. 6B is a longitudinal cross-sectional diagram illustrating a manufacturing process (step following that of FIG. 6A) according to the second manufacturing method of the printing mask of Embodiment 1A.
Figure 6C:
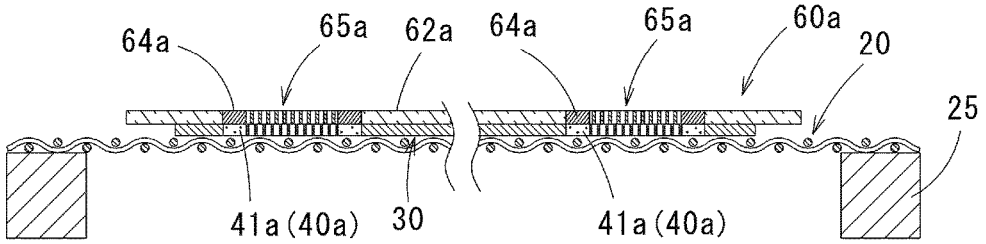
FIG. 6C is a longitudinal cross-sectional diagram illustrating a manufacturing process (step following that of FIG. 6B) according to the second manufacturing method of the printing mask of Embodiment 1A.

As illustrated in FIG. 6A and FIG. 6B, the first photomask 60*a* is then placed (disposed) on the first photocurable resin layer 40*a*. A first photomask overlaid entity (reference number omitted) is thus formed. This step will again be referred to as the first photomask overlaying step.

The image (negative image) on the first photomask 60*a* again corresponds to the structure of the main resin layer 30 and the first additional layer 50Aa of the additional net-like section 50A (FIG. 6D), as was described above in the first manufacturing method.

As illustrated in FIG. 6B, light is then irradiated, from the side of the first photomask 60*a*, onto the first photomask overlaid entity. This step will again be referred to as the first light irradiation step. The light passes through the light transmission section(s) 62*a* and the light transmission section(s) of the first additional layer negative corresponding section 65*a*, and reaches a portions, in the first photocurable resin layer 40*a*, underneath (corresponding to) the light transmitting portions of the first photomask 60*a*, thereby curing the exposed photocurable resin so that it becomes solidly affixed to the main mesh 20. The main resin layer 30 and the first additional layer(s) 50Aa of the additional net-like section(s) 50A are thus formed (latently formed). The main resin layer 30 and the first additional layer(s) 50Aa of the additional net-like section(s) 50A are thus bound onto the main mesh 20. Any photocurable resin that is not exposed to the light remains uncured and in a liquid state. As was indicated above, the preceding steps are identical to the first manufacturing method (FIG. 5A to FIG. 5C) described above.

Figure 6D:
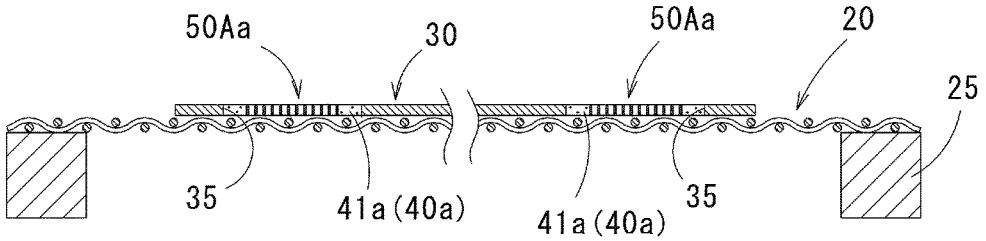
FIG. 6D is a longitudinal cross-sectional diagram illustrating a manufacturing process (step following that of FIG. 6C) according to the second manufacturing method of the printing mask of Embodiment 1A.

As illustrated in FIG. 6D, the first photomask 60*a* is then removed from the above-described first photomask overlaid entity, to yield a first photomask-removed body (not shown). This step will be referred to as the first photomask removal step.

Figure 6E:
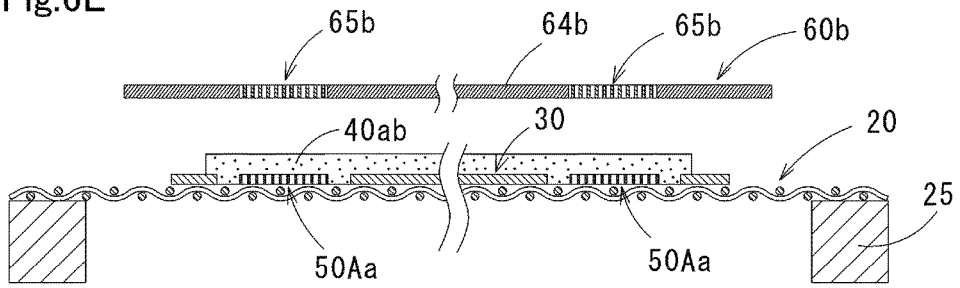
FIG. 6E is a longitudinal cross-sectional diagram illustrating a manufacturing process (step following that of FIG. 6D) according to the second manufacturing method of the printing mask of Embodiment 1A.

Next, each first additional layer 50Aa (including, in some instances, one or more portions other than the first additional layer(s) 50Aa) is coated with an emulsion of a photocurable resin, as illustrated in FIG. 6E. Herein, FIG. 6E illustrates an embodiment in which the photocurable resin emulsion is applied over each first additional layer 50Aa and some or all of the uncured resin 41*a* (FIG. 6D) of the first photocurable resin layer 40*a*, as well at least a substantial part of the main resin layer 30. That is, the first uncured resin removal step of the first manufacturing method is not performed in the second manufacturing method.

Consequently, any uncured resin 41*a* of the first photocurable resin layer 40*a* still present (including any uncured section(s) corresponding to the light transmission blocking section(s) of the first additional layer negative corresponding section(s) 65*a*) (FIG. 6D) becomes integral or mixed with the photocurable resin that is newly applied this time. An integral, uncured fused (intermixed) photocurable resin layer 40*ab* is thus formed. This step will again be referred to as the second photocurable resin coating step.

Figure 6F:
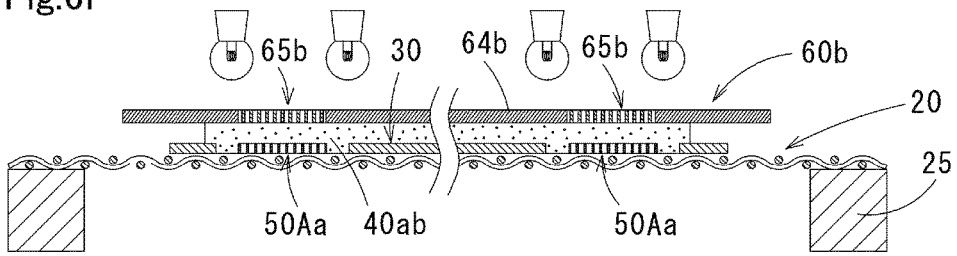
FIG. 6F is a longitudinal cross-sectional diagram illustrating a manufacturing process (step following that of FIG. 6E) according to the second manufacturing method of the printing mask of Embodiment 1A.

As illustrated in FIG. 6E and FIG. 6F, the second photomask 60*b* is then placed (disposed) on the photocurable resin layer 40*ab*, thereby forming a second photomask overlaid entity (reference number omitted). This step will again be referred to as the second photomask overlaying step.

The image (negative image) on the second photomask 60*b* again corresponds to the structure (design) of the second additional layer(s) 50Ab (FIG. 6H) of the additional net-like section(s) 50A, as in the first manufacturing method.

Figure 6G:
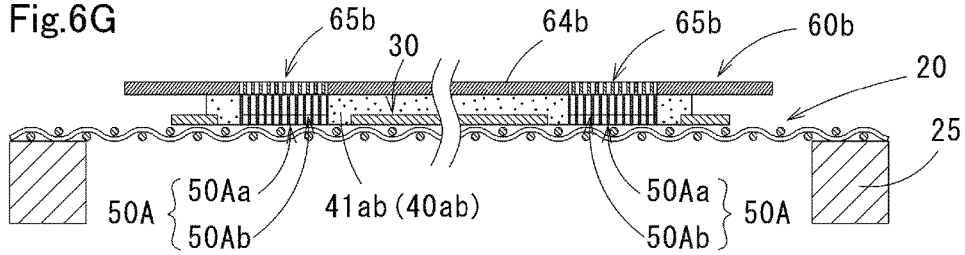
FIG. 6G is a longitudinal cross-sectional diagram illustrating a manufacturing process (step following that of FIG. 6F) according to the second manufacturing method of the printing mask of Embodiment 1A.

Similar to the first manufacturing method, in the second light irradiation step, light is irradiated, from the side of the second photomask 60*b*, onto the second photomask overlaid entity, as illustrated in FIG. 6F, thereby curing (cross-linking) exposed photocurable resin and thus forming the second additional layer(s) 50Ab as shown in FIG. 6G. Unexposed photocurable resin remains in a liquid state, because it is not cured.

Figure 6H:
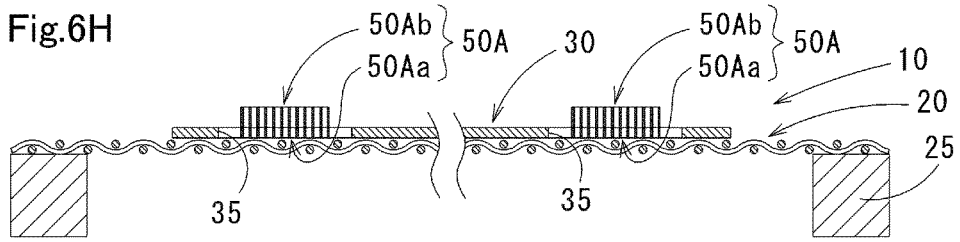
FIG. 6H is a longitudinal cross-sectional diagram illustrating a manufacturing process (step following that of FIG. 6G) according to the second manufacturing method of the printing mask of Embodiment 1A.

Thereafter, the second photomask 60*b* is removed from the above-described second photomask overlaid entity, to yield a second photomask-removed body (not shown). The uncured resin 41*ab* is again removed in the same manner that was described above. As illustrated in FIG. 6H, the first additional layers 50Aa and the second additional layers 50Ab appear (are revealed) to show the additional net-like sections 50A. The printing mask 10 is thus produced.

Figure 7A:
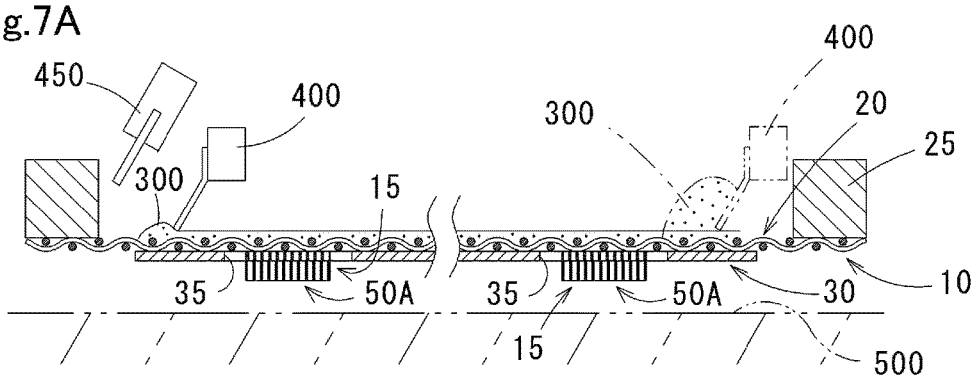
FIG. 7A is a longitudinal cross-sectional diagram illustrating a method (initial step thereof) of using the printing mask of Embodiment 1A.

A representative method of using the above-prepared printing mask 10, as well as the function and effects thereof, will be explained in the following with reference to FIG. 7A to FIG. 7D. First, as illustrated in FIG. 7A, a (substrate) (material to be printed on) 500 (for instance, the rear glass 500A (FIG. 8A) or front glass 500B (FIG. 8B) of an automobile) is set so that the surface to be printed on faces upward. The printing mask 10 is placed onto the upper surface of the material to be printed 500, as illustrated in FIG. 7A.

Still referring to FIG. 7A, the top face of the main mesh 20 of the printing mask 10 is coated with ink 300 by moving a scraper 400 from the position shown with a two-dot chain line to the position shown with a solid line. The interior (the entirety or part thereof) of the exposed mesh (i.e. portion(s) not covered by the main resin layer (stencil) 30) of the main mesh 20 is filled with the ink 300. At the same time, the interior(s) (entirety or part thereof) of the additional net-like section(s) 50A also may become filled with the ink 300.

Figure 7B:
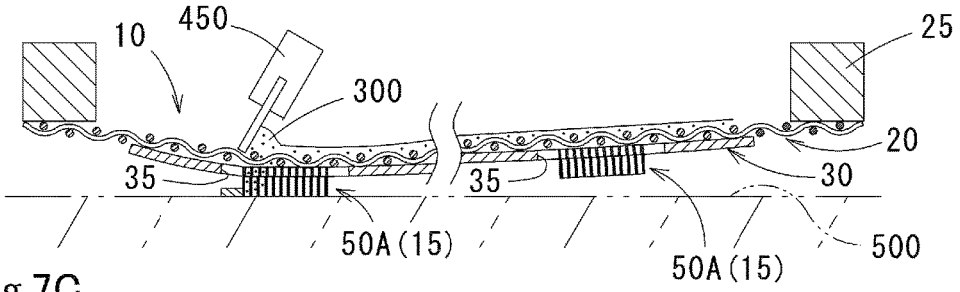
FIG. 7B is a longitudinal cross-sectional diagram illustrating a method (step following that of FIG. 7A) of using the printing mask of Embodiment 1A.
Figure 7C:
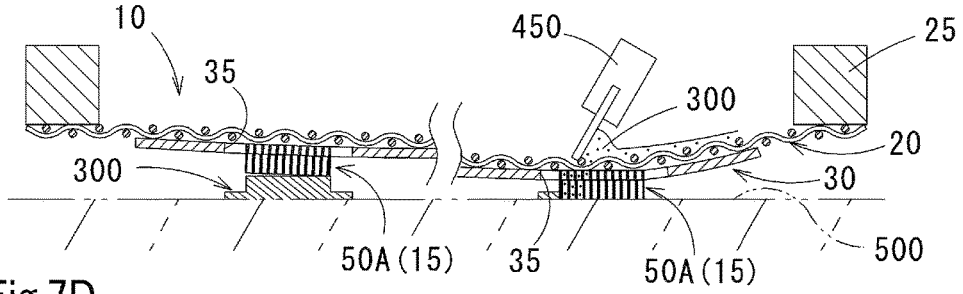
FIG. 7C is a longitudinal cross-sectional diagram illustrating a method (step following that of FIG. 7B) of using the printing mask of Embodiment 1A.
Figure 7D:
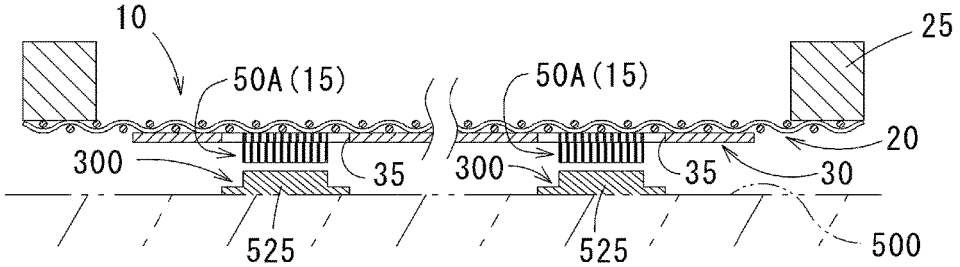
FIG. 7D is a longitudinal cross-sectional diagram illustrating a method (step following that of FIG. 7C) of using the printing mask of Embodiment 1A.

Then, a squeegee (floodbar) 450 is moved over the main mesh 20 while downwardly pressing the ink 300 and the main mesh 20, as illustrated in FIG. 7B and FIG. 7C. Thus, the through-hole(s) 35 and the additional net-like section(s) 50A are reliably filled with the ink 300 (the ink 300 is reliably held therein), and such ink 300 migrates onto the surface of the substrate 500 by passing through the through-hole(s) 35 in the main resin layer 30 of the main mesh 20 including through the additional net-like section(s) 50A. The substrate 500 is thus printed as illustrated in FIG. 7D.

As was described above, the thickness (mesh thickness) of the thick mesh section(s) 15 (portion(s) at which the additional net-like section(s) 50A is (are) provided on the main mesh 20) is thicker than the thickness (mesh thickness) of the main mesh 20 alone (i.e. the portion(s) where the through-hole(s) 35 is (are) provided in the main resin layer 30). Accordingly, a greater amount of ink is held in the thick mesh section(s) 15 than in the main mesh 20 (through-hole(s) 35) where there is no thick mesh section 15.

Accordingly, a relatively small amount of ink 300 migrates onto the portion(s) of the material to be printed on (substrate) 500 that correspond to (is/are underneath) the portion(s) of the main mesh 20 where only the through-hole(s) 35 are present in the main resin layer 30 (i.e. portion(s) at which the additional net-like section(s) 50A is (are) not provided). Consequently, the substrate 500 is thinly printed with the ink 300 at these locations.

On the other hand, a relatively large amount of ink 300 migrates onto the portion(s) of the substrate 500 that correspond(s) to (is/are underneath) the thick mesh section(s) 15 (portion(s) at which the additional net-like section(s) 50A is (are) provided). Consequently, the substrate 500 is thickly printed with the ink 300 at these locations.

The ink becomes uniformly thick, at the respective thinly printed portions and thickly printed portions, through bleeding (spreading) of the ink that has migrated onto the surface of the substrate 500 as described above.

Thus, one or more predetermined portions (i.e. the thick section(s) 525 (FIG. 8A to FIG. 8C)) can be easily printed, with a large thickness by using the printing mask 10 according to the present teachings.

Embodiment 1B

Embodiment 1B, which is a variation of Embodiment 1A, will now be explained with reference to FIG. 3 and FIG. 9, focusing on the differences with respect to Embodiment 1A. Elements common to those in Embodiment 1A will be denoted with the same reference numbers, and an explanation thereof will be omitted (likewise hereafter). In the printing mask of Embodiment 1B, one or more additional net-like sections 50B may (each) be formed by a first additional layer 50Ba and a second additional layer 50Bb, as was described above in the first and second manufacturing methods.

Figure 9:
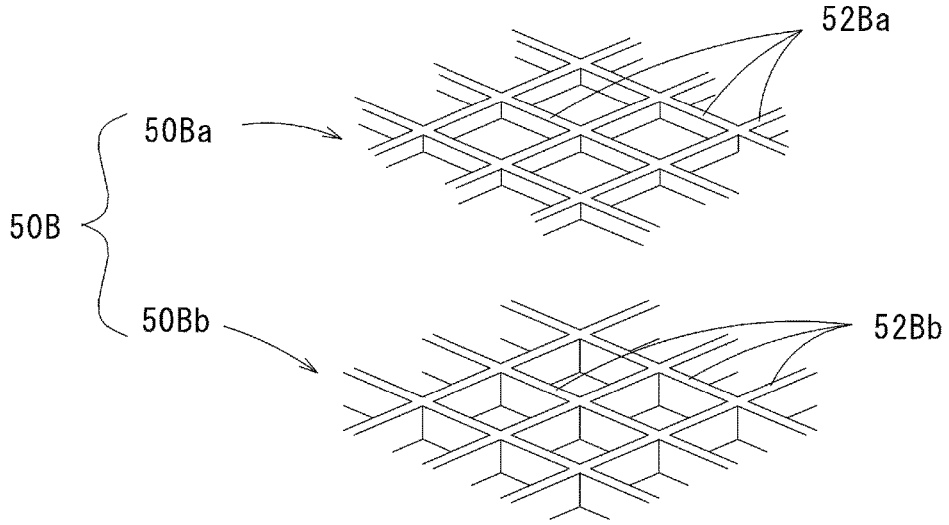
FIG. 9 is an exploded perspective-view diagram illustrating an enlargement of an additional net-like section of a printing mask of Embodiment 1B of the present teachings.

As illustrated in FIG. 9, both the first additional layer 50Ba and the second additional layer 50Bb have a grid-like, i.e. square (or rectangular), network. To form such a network, multiple first layer resin pieces 52Ba that form the respective sides of the squares (or rectangles) are erected, as the first additional layer 50Ba, perpendicularly to the main mesh 20 (FIG. 4), such that adjacent first layer resin pieces 52Ba are interconnected. Similarly in the second additional layer 50Bb as well, multiple second layer resin pieces 52Bb that form the respective sides of the squares (or rectangles) are erected on the first additional layer 50Bb so as to be perpendicular to the main mesh 20, such that adjacent second layer resin pieces 52Bb are interconnected and are connected to adjacent first layer resin pieces 52Ba.

Embodiment 1C

Embodiment 1C, which is another variation of Embodiment 1A, will now be explained with reference to FIG. 3 and FIG. 10, focusing on the differences with respect to Embodiment 1A. In the printing mask of Embodiment 1C, one or more additional net-like sections 50C may be (each) formed by a first additional layer 50Ca and a second additional layer 50Cb, as was described above in the first and second manufacturing methods.

Figure 10:
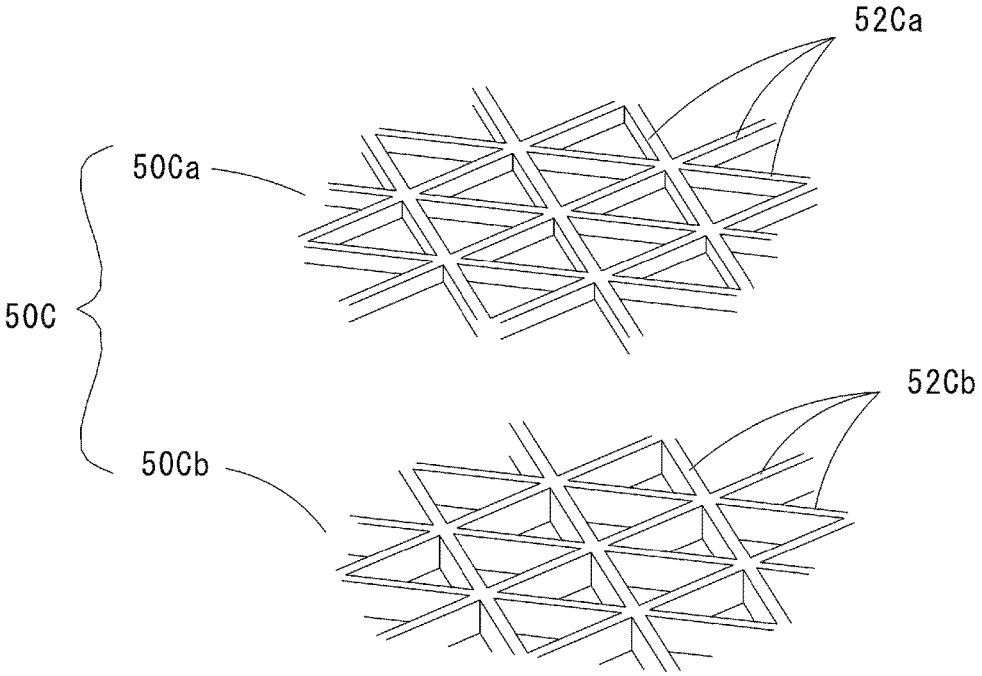
FIG. 10 is an exploded perspective-view diagram illustrating an enlargement of an additional net-like section of a printing mask of Embodiment 1C of the present teachings.

As illustrated in FIG. 10, both the first additional layer 50Ca and the second additional layer 50Cb have a network of equilateral triangles. To form such a network, multiple first layer resin pieces 52Ca that form the respective sides of the equilateral triangles are erected, as the first additional layer 50Ca, perpendicularly to the main mesh 20 (FIG. 4), such that adjacent first layer resin pieces 52Ca are interconnected. Similarly in the second additional layer 50Cb as well, multiple second layer resin pieces 52Cb that form the respective sides of the equilateral triangles are erected on the first additional layer 50Cb so as to be perpendicular to the main mesh 20, such that adjacent second layer resin pieces 52Cb are interconnected and are connected to adjacent first layer resin pieces 52Ca.

Embodiment 1D

Embodiment 1D, which is yet another variation of Embodiment 1A, will now be explained with reference to FIG. 3 and FIG. 11, focusing on the differences with respect to Embodiment 1A. In the printing mask of Embodiment 1D, one or more additional net-like sections 50D may be (each) formed by a first additional layer 50Da and a second additional layer 50Db, as was described above in the first and second manufacturing methods.

Figure 11:
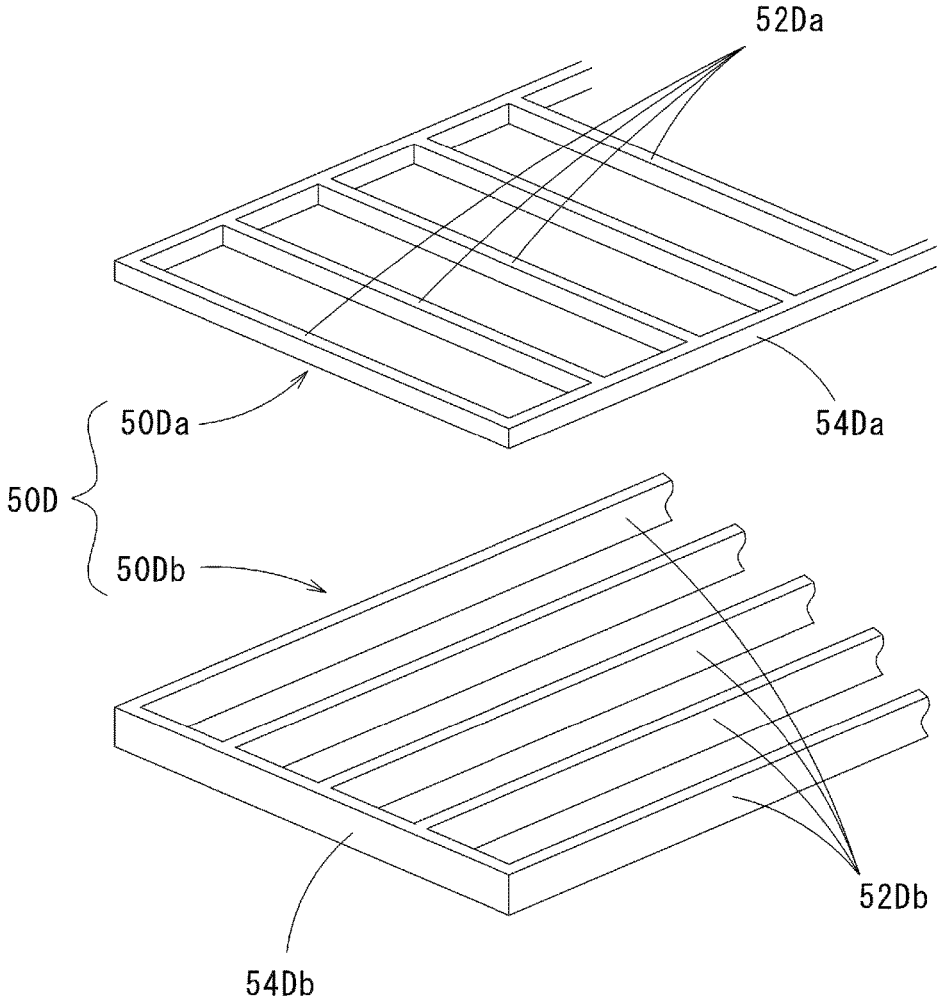
FIG. 11 is an exploded perspective-view diagram illustrating an enlargement of an additional net-like section of a printing mask of Embodiment 1D of the present teachings.

As illustrated in FIG. 11, both the first additional layer 50Da and the second additional layer 50Db have a striped shape, i.e. a shape having a plurality of parallel straight lines (i.e. rectangles). Specifically, multiple first layer resin pieces 52Da that form the respective straight lines are erected, as the first additional layer 50Da, perpendicularly to the main mesh 20. Similarly, in the second additional layer 50Db as well, multiple second layer resin pieces 52Db that form the respective straight lines are erected, on the first additional layer 50Da, so as to be perpendicular to the main mesh 20.

First layer connecting pieces 54Da may be provided to link or connect the respective ends of the first layer resin pieces 52Da to each other. Similarly, second layer connecting pieces 54Db may be provided to link or connect the respective ends of the second layer resin pieces 52Db to each other.

The first layer resin pieces 52Da of the first additional layer 50Da and the second layer resin pieces 52Db of the second additional layer 50Db extend in different directions. In the present example, the first layer resin pieces 52Da of the first additional layer 50Da are perpendicular the second layer resin pieces 52Db of the second additional layer 50Db, although the first layer resin pieces 52Da of the first additional layer 50Da may be simply oblique to the second layer resin pieces 52Db of the second additional layer 50Db.

If the two layers are perpendicular, the additional net-like section 50D as a whole has a grid-like, i.e. square (or rectangular), network.

The printing masks of Embodiment 1B to Embodiment 1D may be produced in the same way as the printing mask 10 of Embodiment 1A, may be used in the same way as the printing mask 10 of Embodiment 1A, and may exhibit similar functions and effects as the printing mask 10 of Embodiment 1A.

Embodiment 2A

Embodiment 2A of the present teachings will be explained in the following with reference to FIG. 12 to FIG. 13H. Embodiment 2A is a variation of Embodiment 1A, and, accordingly, will be explained focusing on the differences with respect to Embodiment 1A. Elements common to those in Embodiment 1A will be denoted with the same reference numbers, and an explanation thereof will be omitted.

Figure 12:
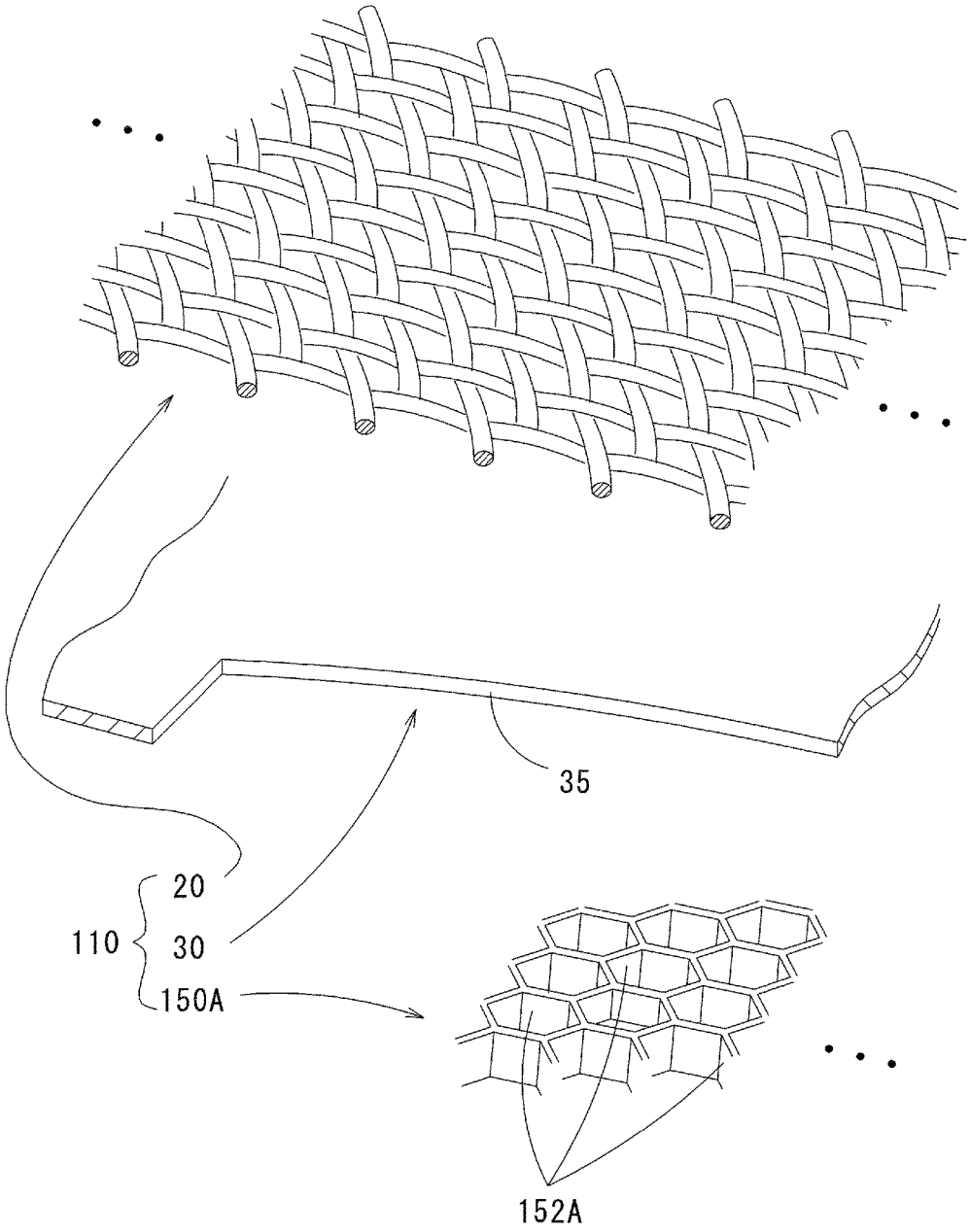
FIG. 12 is an exploded perspective-view diagram illustrating, obliquely from above, an enlarged portion of a printing mask of Embodiment 2A of the present teachings.
Figure 13A:
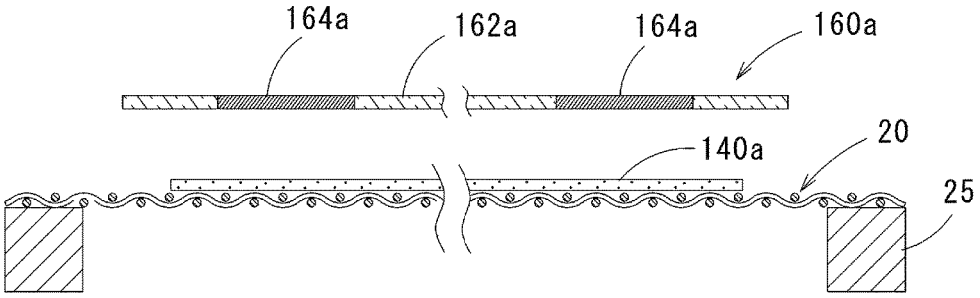
FIG. 13A is a longitudinal cross-sectional diagram illustrating a manufacturing process (initial step thereof) according to a first manufacturing method of the printing mask of Embodiment 2A.
Figure 13B:
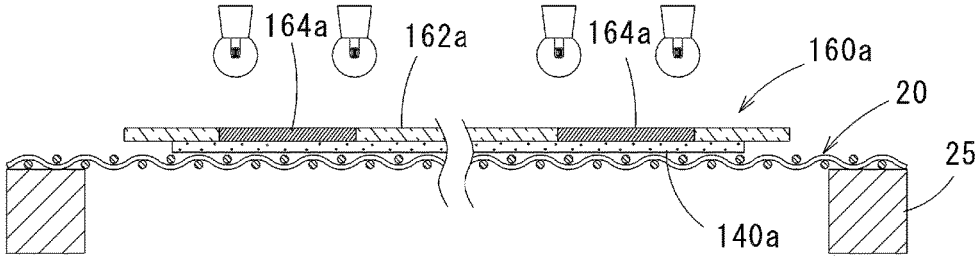
FIG. 13B is a longitudinal cross-sectional diagram illustrating a manufacturing process (step following that of FIG. 13A) according to the first manufacturing method of the printing mask of Embodiment 2A teachings.
Figure 13C:
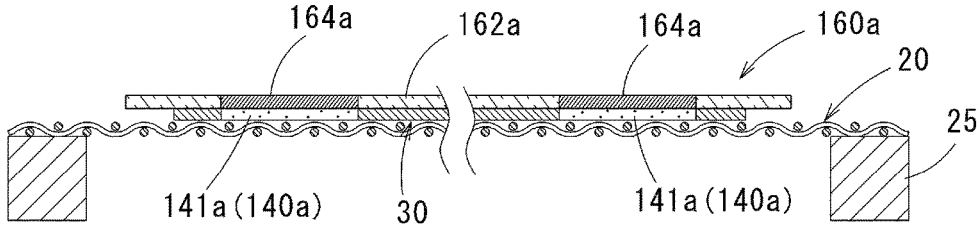
FIG. 13C is a longitudinal cross-sectional diagram illustrating a manufacturing process (step following that of FIG. 13B) according to the first manufacturing method of the printing mask of Embodiment 2A.
Figure 13D:
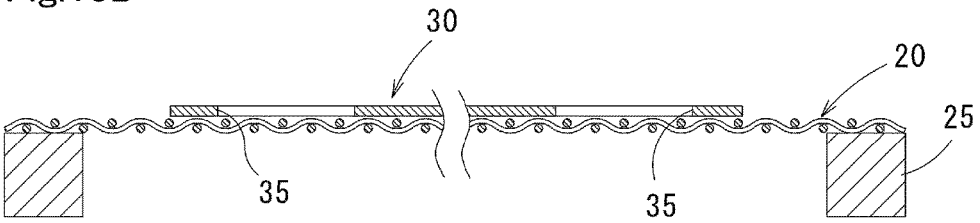
FIG. 13D is a longitudinal cross-sectional diagram illustrating a manufacturing process (step following that of FIG. 13C) according to the first manufacturing method of the printing mask of Embodiment 2A.
Figure 13E:
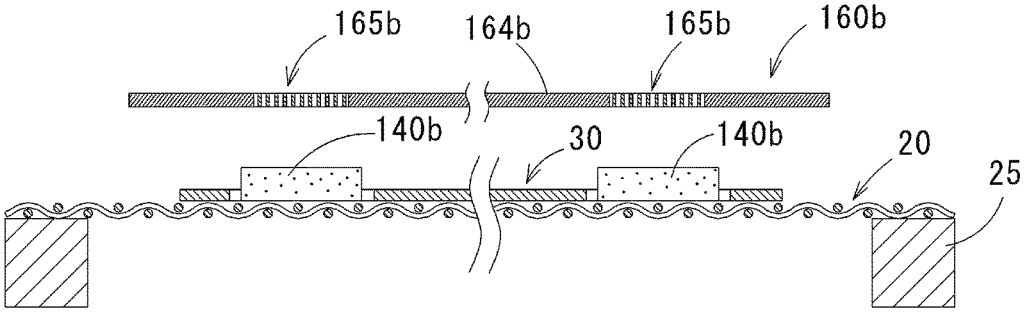
FIG. 13E is a longitudinal cross-sectional diagram illustrating a manufacturing process (step following that of FIG. 13D) according to the first manufacturing method of the printing mask of Embodiment 2A.
Figure 13F:
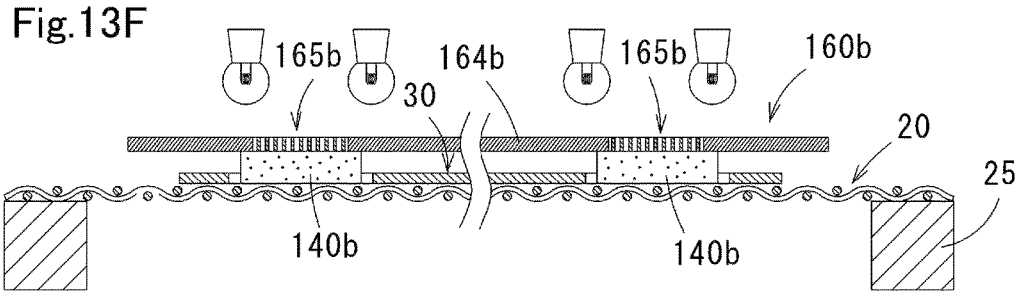
FIG. 13F is a longitudinal cross-sectional diagram illustrating a manufacturing process (step following that of FIG. 13E) according to the first manufacturing method of the printing mask of Embodiment 2A.
Figure 13G:
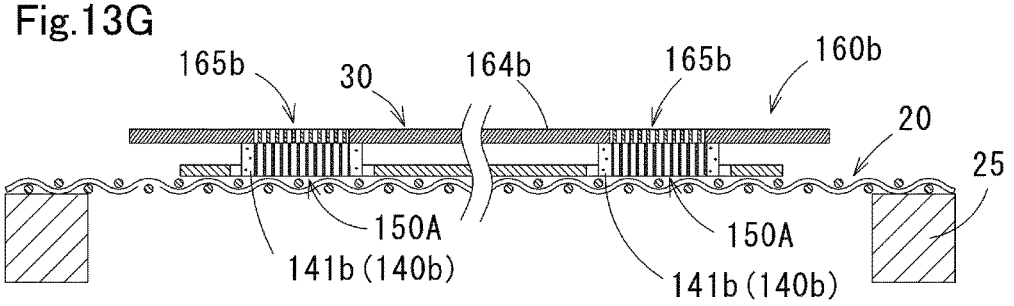
FIG. 13G is a longitudinal cross-sectional diagram illustrating a manufacturing process (step following that of FIG. 13F) according to the first manufacturing method of the printing mask of Embodiment 2A.
Figure 13H:
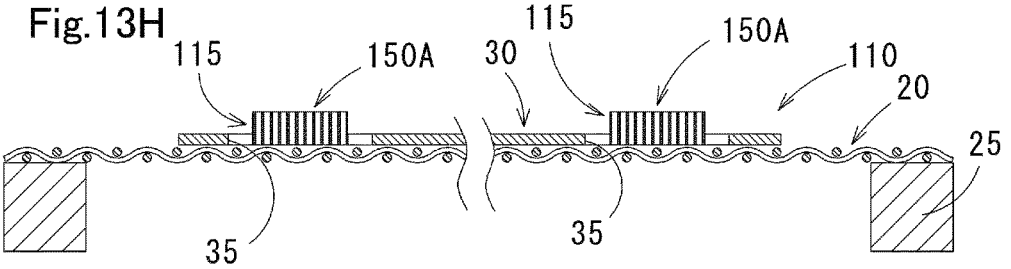
FIG. 13H is a longitudinal cross-sectional diagram illustrating a manufacturing process (step following that of FIG. 13G) according to the first manufacturing method of the printing mask of Embodiment 2A.

As illustrated in FIG. 12 and FIG. 13H, a printing mask 110 has the main mesh (screen) 20, the main resin layer (stencil) 30 and one or more additional net-like sections (hollow cells) 150A. The thickness of the main mesh 20 may be again, for instance, 60 μm.

The main resin layer 30 is attached to the lower face of the main mesh 20 (lower face in a state in which the printing mask 110 will be used). The main resin layer 30 is formed from a photocurable resin. One or more through-holes 35 is (are) again formed in the main resin layer 30. The (each) through-hole 35 is formed so as to correspond to the bus bars 520 and heating wires 510 (FIG. 8A) or border 522 (FIGS. 8B and 8C) described above. The thickness of the main resin layer 30 (other than the through-hole(s) 35) is again for instance 6 μm.

One or more additional net-like sections 150A is (are) provided, on the main mesh 20, at one or more locations within the through-hole(s) 35 of the main resin layer 30. The additional net-like section(s) 150A is (are) formed so as to correspond to the thick section(s) 525A in the bus bars 520 (FIG. 8A), or the thick section 525B (FIG. 8C) in the border 522 (FIGS. 8B and 8C) described above. The portion(s) at which the additional net-like section(s) 150A is (are) provided on the main mesh 20, i.e. the portion(s) at which the additional net-like section(s) 150A overlap(s) (is/are superimposed on) the main mesh 20, will be referred to as thick mesh section(s) 115.

The additional net-like section(s) 150A may also be formed from the photocurable resin that was used to form the main resin layer 30. The additional net-like section(s) 150A is (are) formed of one layer. The thickness of the additional net-like section(s) 150A is again for instance 66 μm. In the printing mask 110, the thickness (mesh thickness) of the main mesh 20 is thus for instance 60 μm, as described above, while the thickness (mesh thickness) of the thick mesh section 115 (FIG. 13H) is for instance: 60 μm (thickness of the main mesh 20)+66 μm (thickness of the (each) additional net-like section 150A)=126 μm.

The additional net-like section 150A will now be explained in greater detail. As illustrated at the bottom of FIG. 12, the (each) additional net-like section 150A has a honeycomb shape, i.e. a network of regular hexagonal shapes (substantially regular hexagonal shapes). To form the network of regular hexagonal shapes, multiple resin pieces 152A that form the respective sides of the regular hexagonal shapes are erected, perpendicularly to the main mesh 20, such that adjacent resin pieces 152A are interconnected. The height of the resin pieces 152A is the thickness of the additional net-like section 150A, and is for instance 66 μm, as described above.

A third method for manufacturing a printing mask (in this case, the printing mask 110) will be explained in the following with reference to FIG. 13A to FIG. 13H. The main mesh 20 is prepared first, as illustrated in FIG. 13A and is attached to the frame 25. In the manufacturing process of the printing mask 110 (FIG. 13A to FIG. 13H), the printing mask 110 (FIG. 13H) and the manufacturing intermediates thereof (FIG. 13A to FIG. 13G) are in a state vertically reversed with respect to the state in which the printing mask will be used.

As illustrated in FIG. 13A, the top face (lower face while in use) of the main mesh 20 is coated with an emulsion of a photocurable resin to form a first photocurable resin layer 140*a* in a first photocurable resin coating step, in a manner similar to the first and second manufacturing methods described above.

Next, as illustrated in FIG. 13A and FIG. 13B, a first photomask 160*a* is placed (disposed) on the first photocurable resin layer 140*a*, thereby forming a first photomask overlaid entity (reference number omitted). This step will again be referred to as the first photomask overlaying step.

The image (negative image) on the first photomask 160*a* corresponds to the structure (design) of the main resin layer 30 (FIG. 13D). More specifically, the portion(s), in the first photomask 160*a*, corresponding to the through-hole(s) 35 (FIG. 13D) of the main resin layer 30, are light transmission blocking section(s) 164*a*, and the portion(s) corresponding to the portion(s) other than the through-hole(s) 35 of the main resin layer 30 are light transmission section(s) 162*a* (i.e. transparent). This step is again similar to the corresponding step in the first and second manufacturing methods described above, but as will be described below, the first photomask 160*a* does not include image portions corresponding to a first additional layer of the net-like section 150A.

As illustrated in FIG. 13B, light is then irradiated, from the side of the first photomask 160*a*, onto the first photomask overlaid entity in the first light irradiation step, in a manner similar to the first and second manufacturing methods described above. Therefore, light passes through the light transmission section(s) 162*a*, in the first photomask 160*a*, and reaches (a) portion(s), in the first photocurable resin layer 140*a*, corresponding to (underneath) the light transmission section(s) 162*a*. As illustrated in FIG. 13C, exposed resin is cured and becomes solidly affixed to the main mesh 20. The main resin layer 30 is thus formed (latently formed) and integrally provided on the main mesh 20. On the other hand, no light reaches the portion(s), in the first photocurable resin layer 140*a*, corresponding to (underneath) the light transmission blocking section(s) 164*a* of the first photomask 160*a*, and unexposed resin does not undergo curing. This still liquid photocurable resin will be referred to as uncured resin 141*a*.

Thereafter, the first photomask 160*a* is removed from the above-described first photomask overlaid entity, to yield a first photomask-removed body (not shown). The uncured resin 141*a* may then be removed in a manner similar to the first and second manufacturing methods described above, although in the fourth manufacturing method (described below) it is possible to omit this step. The main resin layer 30 having the through-hole(s) 35 appears (is revealed), as illustrated in FIG. 13D. This step will again be referred to as the first uncured resin removal step.

Next, the portions on the top face of the main mesh 20 (including, in some instances, the periphery of such portions), which correspond to the additional net-like sections 150A (FIG. 13H) that will be formed, are coated with an emulsion of a photocurable resin to form respective second photocurable resin layers 140*b*. This step will again be referred to as the second photocurable resin coating step.

Next, as illustrated in FIG. 13E and FIG. 13F, a second photomask 160*b* is placed (disposed) on the second photocurable resin layers 140*b*. A second photomask overlaid entity (reference number omitted) is thus formed. This step will again be referred to as the second photomask arrangement step.

As illustrated in FIG. 13E and FIG. 13F, a single second photomask 160*b* may be disposed so as to correspond to (cover) all the second photocurable resin layers 140*b*, but it is also possible to dispose a plurality of second photomasks (160*b*), not shown, corresponding to (respectively covering) the second photocurable resin layers 140*b*.

The image (negative image) on the second photomask 160*b* corresponds to the structure (design) of the additional net-like sections 150A (FIG. 13H). More specifically, the portions of the second photomask 160*b*, which correspond to the additional net-like sections 150A (FIG. 13H), are additional net-like section negative corresponding sections (i.e. light transmitting portions) 165*b*, and portions other than those are light transmission blocking sections 164*b*. In the (each) additional net-like section negative corresponding section 165*b*, portions corresponding to the resin pieces 152A (FIG. 12) of the additional net-like section 150A are light transmission sections (reference number omitted), and portions other than those are light transmission blocking sections (reference number omitted).

Light is then irradiated, from the side of a second photomask 160*b*, onto the second photomask overlaid entity, as illustrated in FIG. 13F. This step will again be referred to as the second light irradiation step. The light passes through a light transmission sections (reference number omitted) in the second photomask 160*b* (additional net-like section negative corresponding sections 165*b*), and reaches portions, in the second photocurable resin layers 140*b*, corresponding to (underneath) the light transmission sections thereof. As illustrated in FIG. 13G, exposed resin is cured (cross-linked) and becomes solidly affixed to the main mesh 20. The additional net-like section(s) 150A are thus formed (latently formed) and are integrally provided on the main mesh 20. On the other hand, no light reaches the portions, in the second photocurable resin layer 140*b*, corresponding to the light transmission blocking section(s) 164*b* of the second photomask 160*b* including the light transmission blocking section of the additional net-like section negative corresponding sections 165*b*), and unexposed resin does not undergo curing. This still-liquid photocurable resin will be referred to as uncured resin 141*b*.

Finally, the second photomask 160*b* is removed from the above-described second photomask overlaid entity, to yield a second photomask-removed body (not shown) and the uncured resin 141*b* is removed, in a manner similar to the first and second manufacturing methods described above. As illustrated in FIG. 13H, the additional net-like sections 150A appear (are revealed) over (under, when in use) the main mesh 20. The printing mask 110 is thus produced as described above.

A fourth method for manufacturing a printing mask (again, the printing mask 110) will be explained in the following with respect to FIG. 14A to FIG. 14H. In summary, similar to the first and second manufacturing methods described above, the fourth manufacturing method differs from the third manufacturing method only in that the first uncured resin removal step is omitted. That is, when the first photomask 160*a* is removed after the first light irradiation step, additional photocurable resin 141*a* is disposed on the main mesh 20 without removing the photocurable resin 141*a* that remains uncured after the first light irradiation step. Otherwise, the third and fourth manufacturing methods may be identical, as will become apparent from the following description of the fourth manufacturing method.

Figure 14A:
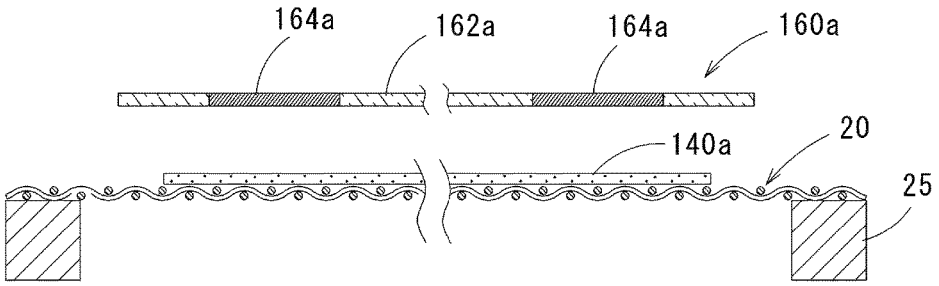
FIG. 14A is a longitudinal cross-sectional diagram illustrating a manufacturing process (initial step thereof) according to a second manufacturing method of the printing mask of Embodiment 2A.

The main mesh 20 is prepared first, as illustrated in FIG. 14A, and is attached to the frame 25. In the manufacturing process of the printing mask 110 (FIG. 14A to FIG. 14H), the printing mask 110 (FIG. 14H) and the manufacturing intermediates thereof (FIG. 14A to FIG. 14G) are in a state vertically reversed with respect to the state in which the printing mask will be used.

As illustrated in FIG. 14A, the top face (lower face while in use) of the main mesh 20 is coated with an emulsion of a photocurable resin to form the first photocurable resin layer 140*a* in the first photocurable resin coating step, similar to the above described manufacturing methods.

Figure 14B:
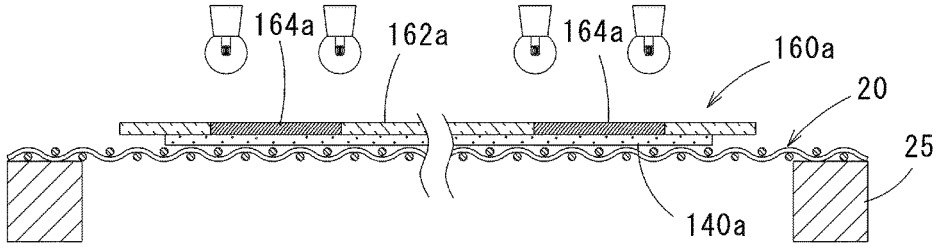
FIG. 14B is a longitudinal cross-sectional diagram illustrating a manufacturing process (step following that of FIG. 14A) according to the second manufacturing method of the printing mask of Embodiment 2A.

Next, as illustrated in FIG. 14A and FIG. 14B, the first photomask 160*a* is placed (disposed) on the first photocurable resin layer 140*a*, thereby forming a first photomask overlaid entity (reference number omitted). This step will again be referred to as the first photomask overlaying step.

Figure 14C:
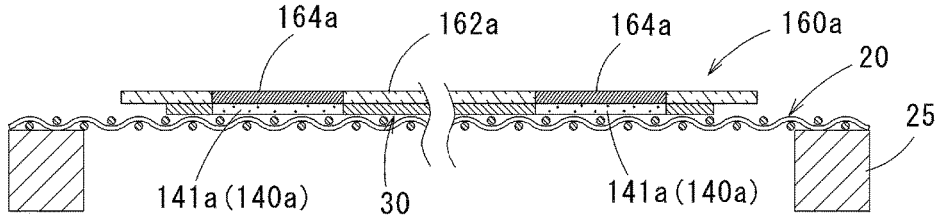
FIG. 14C is a longitudinal cross-sectional diagram illustrating a manufacturing process (step following that of FIG. 14B) according to the second manufacturing method of the printing mask of Embodiment 2A.
Figure 14D:
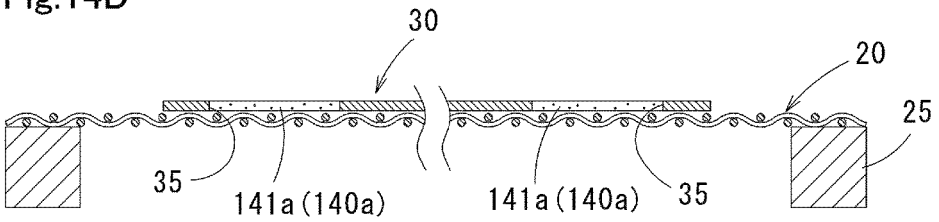
FIG. 14D is a longitudinal cross-sectional diagram illustrating a manufacturing process (step following that of FIG. 14C) according to the second manufacturing method of the printing mask of Embodiment 2A.

The image (negative image) on the first photomask 160*a* again corresponds to the structure (design) of the main resin layer 30 (FIG. 14D). More specifically, the portion(s), in the first photomask 160*a*, corresponding to the through-hole(s) 35 (FIG. 14D) of the main resin layer 30, is (are) light transmission blocking section(s) 164*a*, and the portion(s) corresponding to the portion(s) other than the through-hole(s) 35 of the main resin layer 30 is (are) light transmission section(s) 162*a* (i.e. transparent).

As illustrated in FIG. 14B, light is then irradiated, from the side of the first photomask 160*a*, onto the first photomask overlaid entity in the first light irradiation step. The light passes through the light transmission section(s) 162*a*, in the first photomask 160*a*, and reaches (a) portion(s), in the first photocurable resin layer 140*a*, corresponding to (underneath) the light transmission section(s) 162*a*. As illustrated in FIG. 14C, exposed resin is cured and becomes solidly affixed to the main mesh 20. The main resin layer 30 is thus formed (latently formed) and is integrally provided on the main mesh 20. On the other hand, no light reaches the portion(s), in the first photocurable resin layer 140*a*, corresponding to (underneath) the light transmission blocking section(s) 164*a* of the first photomask 160*a*, and unexposed resin does not undergo curing. This still-liquid photocurable resin will again be referred to as uncured resin 141*a*. Thus far, the method is identical to the third manufacturing method (FIG. 13A to FIG. 13C) described above.

As illustrated in FIG. 14D, the first photomask 160*a* is then removed from the above-described first photomask overlaid entity, to yield a first photomask-removed body (not shown) in the first photomask removal step.

Figure 14E:
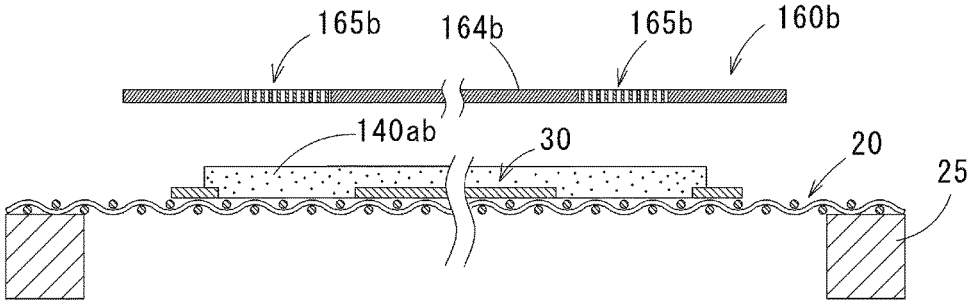
FIG. 14E is a longitudinal cross-sectional diagram illustrating a manufacturing process (step following that of FIG. 14D) according to the second manufacturing method of the printing mask of Embodiment 2A.

Next, without first removing the uncured resin 141*a* (FIG. 14D) within the first photocurable resin layer 140*a* (which may include only the portions at which each additional net-like section 150A is formed, or may include all the uncured resin 141*a*, and portions other than that), additional emulsion of a photocurable resin is coated onto the main mesh 20 and main resin layer 30, as illustrated in FIG. 14E. Thus, FIG. 14E illustrates an embodiment in which the photocurable resin emulsion is applied over uncured resin 141*a* (FIG. 14D) within the first photocurable resin layer 140*a*, and the greater part of the main resin layer 30.

The newly-applied resin thus mixes and becomes integral with the uncured resin 141*a* (FIG. 14D) within the first photocurable resin layer 140*a*. An integral photocurable resin layer 140*ab* is thus formed in the second photocurable resin coating step.

Figure 14F:
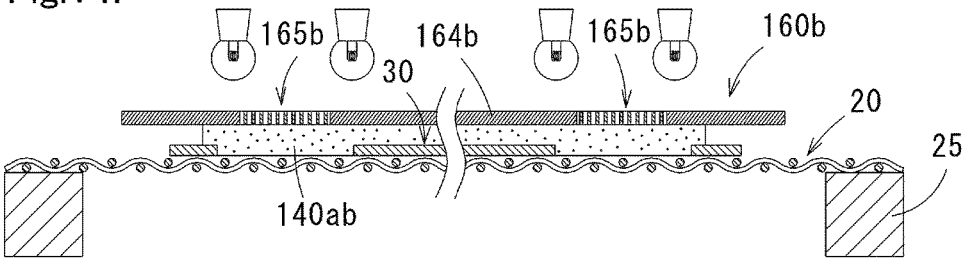
FIG. 14F is a longitudinal cross-sectional diagram illustrating a manufacturing process (step following that of FIG. 14E) according to the second manufacturing method of the printing mask of Embodiment 2A.

Next, as illustrated in FIG. 14E and FIG. 14F, the second photomask 160*b* is placed (disposed) on the intermixed (fused) photocurable resin layer 140*ab*, thereby forming a second photomask overlaid entity (reference number omitted). This step will again be referred to as the second photomask arrangement step.

Figure 14G:
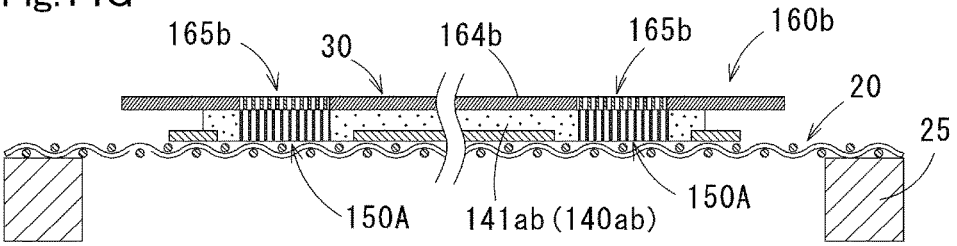
FIG. 14G is a longitudinal cross-sectional diagram illustrating a manufacturing process (step following that of FIG. 14F) according to the second manufacturing method of the printing mask of Embodiment 2A.
Figure 14H:
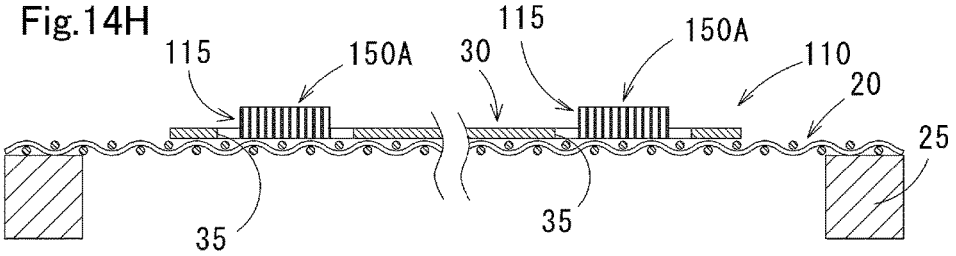
FIG. 14H is a longitudinal cross-sectional diagram illustrating a manufacturing process (step following that of FIG. 14G) according to the second manufacturing method of the printing mask of Embodiment 2A.

The image (negative image) on the second photomask 160*b* again corresponds to the structure (design) of the additional net-like section(s) 150A (FIG. 14H). More specifically, the portions, in the second photomask 160*b*, corresponding to the additional net-like sections 150A (FIG. 14H) are additional net-like section negative corresponding sections (light transmitting sections) 165*b*, and portions other than those are light transmission blocking sections 164*b*. In the (each) additional net-like section negative corresponding section 165*b*, portions corresponding to the resin pieces 152A (FIG. 12) of the additional net-like section 150A are light transmission sections (reference number omitted), and portions other than those are light transmission blocking sections (reference number omitted).

Light is then irradiated, from the side of a second photomask 160*b*, onto the second photomask overlaid entity, as illustrated in FIG. 14F in the second light irradiation step. The light passes through the light transmission sections (reference number omitted) in the second photomask 160*b* (additional net-like section negative corresponding sections 165*b*), and reaches portions, in the photocurable resin layer 140*ab*, corresponding to (underneath) the light transmission sections thereof. As illustrated in FIG. 14G, exposed resin is cured and becomes solidly affixed to the main mesh 20. The additional net-like sections 150A are thus formed thus (latently formed) and are integrally provided on (fused to) the main mesh 20. On the other hand, no light reaches the portions, in the fused photocurable resin layer 140*ab*, corresponding to (underneath) the light transmission blocking sections 164*b* of the second photomask 160*b* (including the light transmission blocking sections of the additional net-like section negative corresponding sections 165*b*) and unexposed resin does not undergo curing. This still-liquid photocurable resin will again be referred to as uncured resin 141*ab*.

Next, the second photomask 160*b* is removed from the above-described second photomask overlaid entity, to yield a second photomask-removed body (not shown), and the uncured resin 141*ab* is removed, e.g., in the same manner as was described above, so that the additional net-like sections 150A appear (are revealed) over (under, when in use) the main mesh 20, as illustrated in FIG. 14H.

The printing mask 110 of Embodiment 2A may be used in the same way as the printing mask 10 of Embodiment 1A, and may exhibit similar functions and effects to those of the printing mask 10 of Embodiment 1A.

Embodiment 2B

Figure 15:
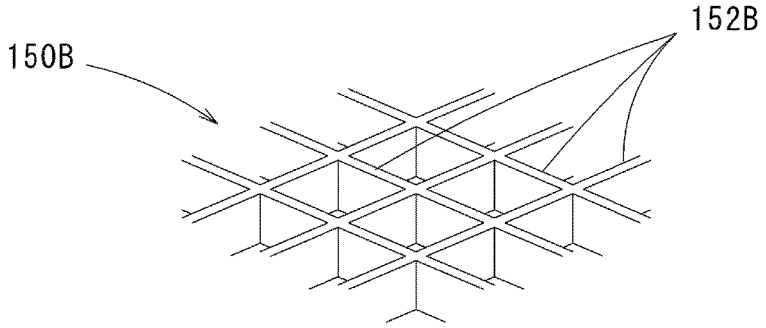
FIG. 15 is an exploded perspective-view diagram illustrating an enlargement of an additional net-like section of a printing mask of Embodiment 2B of the present teachings.

Embodiment 2B, which is a variation of Embodiment 2A, will now be explained with reference to FIG. 15, focusing on the differences with respect to Embodiment 2A. Elements common to those in Embodiment 2A will be denoted with the same reference numbers, and an explanation thereof will be omitted (likewise hereafter).

In this printing mask as well, an additional net-like section 150B is formed as one layer. The additional net-like section 150B as a whole has thus a grid-like, i.e. square (or rectangular), network. To form such a network, multiple first layer resin pieces 152B that form the respective sides of the squares (or rectangles) are erected perpendicularly to the main mesh 20 (FIG. 4), such that adjacent resin pieces 152B are interconnected.

Embodiment 2C

Figure 16:
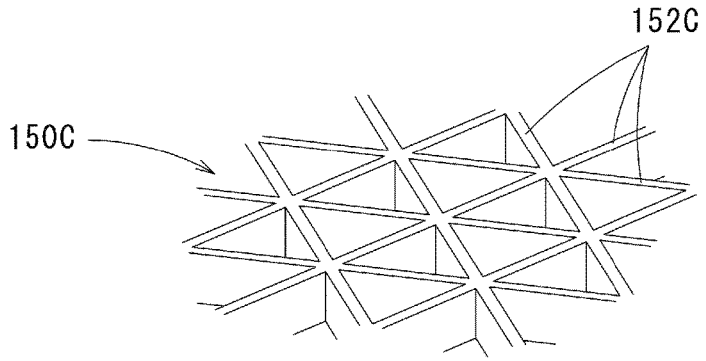
FIG. 16 is an exploded perspective-view diagram illustrating an enlargement of an additional net-like section of a printing mask of Embodiment 2C of the present teachings.

Embodiment 2C, which is another variation of Embodiment 2A, will now be explained with reference FIG. 16, focusing on the differences with respect to Embodiment 2A.

In this printing mask as well, an additional net-like section 150C is formed as one layer. The additional net-like section 150C has a network of equilateral triangles. To form such a network, multiple first layer resin pieces 152C that form the respective sides of the equilateral triangles are erected perpendicularly to the main mesh 20 (FIG. 4), such that adjacent resin pieces 152C are interconnected.

Embodiment 2D

Figure 17:
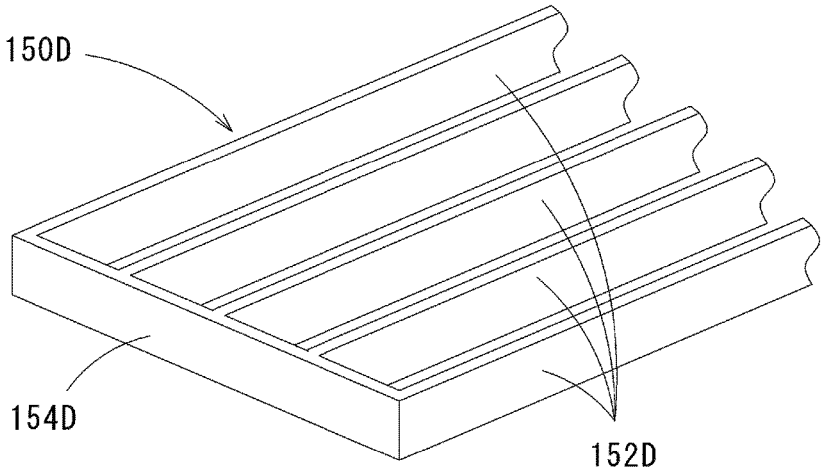
FIG. 17 is an exploded perspective-view diagram illustrating an enlargement of an additional net-like section of a printing mask of Embodiment 2D of the present teachings.

Embodiment 2D, which is yet another variation of Embodiment 2A, will now be explained with reference to FIG. 17, focusing on the differences with respect to Embodiment 2A.

In this printing mask as well, an additional net-like section 150D is formed as one layer. The additional net-like section 150D has a striped shape, i.e. a shape having a plurality of parallel straight lines. Specifically, multiple resin pieces 152D that form the straight lines are erected perpendicularly to the main mesh 20 (FIG. 4). Connecting pieces 154D may be formed to link (connect) respective ends of the resin pieces 152D to each other.

The printing masks in Embodiment 2B to Embodiment 2D may be produced in the same way as the printing mask 10 of Embodiment 2A, may be used in the same way as the printing mask 10 of Embodiment 2A, and may exhibit similar functions and effects to those of the printing mask 10 of Embodiment 2A.

The features described above are merely representative exemplary embodiments of the present teachings, and it should be evident that the present teachings can be carried out in forms that include various modifications based on the knowledge of a person skilled in the art.

As a variation of Embodiments 1A to 1D, for instance, the additional net-like section(s) (50A to 50D) may be formed as a combination of any one of the first additional layers 50Aa to 50Da of Embodiments 1A to 1D, and any one of the second additional layers 50Ab to 50Db of Embodiments 1A to 1D.

As a variation of Embodiment 1A to 1D, the first layer resin pieces (52Aa to 52Da) in the first additional layer (50Aa to 50Da) of the additional net-like section (50A to 50D) need not be interconnected.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved screen printing masks and methods of making and using the same.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Although some aspects of the present invention have been described in the context of a device or apparatus, it is to be understood that these aspects also represent a description of a corresponding method, so that a block or a component of a device or apparatus is also understood as a corresponding method step or as a feature of a method step. In an analogous manner, aspects which have been described in the context of or as a method step also represent a description of a corresponding block or detail or feature of a corresponding device.

Additional embodiments disclosed herein include but are not limited to:

1. A screen printing mask for performing screen printing on a material to be printed on, comprising a main mesh; a main resin layer provided on the main mesh by curing, through absorption of light, photocurable resin that is applied onto the main mesh, the main resin layer having a through-hole; and an additional net-like section provided on the main mesh by curing, through absorption of light, photocurable resin that is applied onto the main mesh, the additional net-like section being disposed within the through-hole of the main resin layer.

2. The screen printing mask according to the above-mentioned embodiment 1, wherein the additional net-like section has a first additional layer provided on the main mesh together with the main resin layer by curing, through absorption of light, the photocurable resin that is applied onto the main mesh, in the through-hole of the main resin layer; and a second additional layer provided on the first additional layer by curing, through absorption of light, a photocurable resin that is applied onto the first additional layer.

3. A screen printing mask manufacturing method for producing a screen printing mask that includes a main mesh, a main resin layer provided on the main mesh and having a through-hole, and an additional net-like section provided on the main mesh and within the through-hole of the main resin layer, the method comprising:

a first photocurable resin coating step of forming a first photocurable resin layer by coating the main mesh with photocurable resin;

a first photomask overlaying step of forming a first photomask overlaid entity by disposing, on the first photocurable resin layer, a first photomask having a light transmission section corresponding to a structure of the main resin layer;

a first light irradiation step of forming the main resin layer by irradiating light onto the first photomask overlaid entity from the first photomask side to thereby cure a portion, in the first photocurable resin layer, corresponding to the light transmission section of the first photomask;

a first uncured resin removal step of removing the first photomask from the first photomask overlaid entity, and removing uncured photocurable resin in the first photocurable resin layer;

a second photocurable resin coating step of forming a second photocurable resin layer by coating the main mesh with photocurable resin within the through-hole of the main resin layer;

a second photomask overlaying step of forming a second photomask overlaid entity by disposing, on the second photocurable resin layer, a second photomask having a light transmission section corresponding to a structure of the additional net-like section;

a second light irradiation step of forming the additional net-like section by irradiating light onto the second photomask overlaid entity from the second photomask side to thereby cure a portion, in the second photocurable resin layer, corresponding to the light transmission section of the second photomask; and a second uncured resin removal step of removing the second photomask from the second photomask overlaid entity, and removing uncured photocurable resin in the second photocurable resin layer.

4. A screen printing mask manufacturing method for producing a screen printing mask that includes a main mesh, a main resin layer provided on the main mesh and having a through-hole, and an additional net-like section provided on the main mesh and within the through-hole of the main resin layer, the method comprising:

a first photocurable resin coating step of forming a first photocurable resin layer by coating the main mesh with photocurable resin;

a first photomask overlaying step of forming a first photomask overlaid entity by disposing, on the first photocurable resin layer, a first photomask having a light transmission section corresponding to a structure of the main resin layer;

a first light irradiation step of forming the main resin layer by irradiating light onto the first photomask overlaid entity from the first photomask side to thereby cure a portion, in the first photocurable resin layer, corresponding to the light transmission section of the first photomask;

a first photomask removal step of removing the first photomask from the first photomask overlaid entity;

a second photocurable resin coating step of further coating, with photocurable resin, uncured photocurable resin of the first photocurable resin layer to thereby form an intermixed photocurable resin layer together with uncured photocurable resin of the first photocurable resin layer;

a second photomask overlaying step of forming a second photomask overlaid entity by disposing, on the intermixed photocurable resin layer, a second photomask having a light transmission section corresponding to a structure of the additional net-like section;

a second light irradiation step of forming the additional net-like section by irradiating light onto the second photomask overlaid entity from the second photomask side to thereby cure a portion, in the intermixed photocurable resin layer, corresponding to the light transmission section of the second photomask; and an uncured resin removal step of removing the second photomask from the second photomask overlaid entity, and removing uncured photocurable resin in the intermixed photocurable resin layer.

5. A screen printing mask manufacturing method for producing a screen printing mask that includes a main mesh, a main resin layer provided on the main mesh and having a through-hole, and an additional net-like section provided on the main mesh and within the through-hole of the main resin layer, the additional net-like section having a first additional layer and a second additional layer, the method comprising:

a first photocurable resin coating step of forming a first photocurable resin layer by coating the main mesh with photocurable resin;

a first photomask overlaying step of forming a first photomask overlaid entity by disposing, on the first photocurable resin layer, a first photomask having light transmission sections corresponding to a structure of the main resin layer and a structure of the first additional layer;

a first light irradiation step of forming the main resin layer and the first additional layer by irradiating light onto the first photomask overlaid entity from the first photomask side to thereby cure portions, in the first photocurable resin layer, corresponding to the light transmission sections of the first photomask;

a first uncured resin removal step of removing the first photomask from the first photomask overlaid entity, and removing uncured photocurable resin in the first photocurable resin layer;

a second photocurable resin coating step of forming a second photocurable resin layer by coating the first additional layer with photocurable resin;

a second photomask overlaying step of forming a second photomask overlaid entity by disposing, on the second photocurable resin layer, a second photomask having a light transmission section corresponding to a structure of the second additional layer;

a second light irradiation step of forming the second additional layer by irradiating light onto the second photomask overlaid entity from the second photomask side to thereby cure a portion, in the photocurable resin layer, corresponding to the light transmission section of the second photomask; and a second uncured resin removal step of removing the second photomask from the second photomask overlaid entity and removing uncured photocurable resin in the second photocurable resin layer.

6. A screen printing mask manufacturing method for producing a screen printing mask that includes a main mesh, a main resin layer provided on the main mesh and having a through-hole, and an additional net-like section provided on the main mesh and within the through-hole of the main resin layer, the additional net-like section having a first additional layer and a second additional layer, the method comprising:

a first photocurable resin coating step of forming a first photocurable resin layer by coating the main mesh with photocurable resin;

a first photomask overlaying step of forming a first photomask overlaid entity by disposing, on the first photocurable resin layer, a first photomask having light transmission sections corresponding to a structure of the main resin layer and a structure of the first additional layer;

a first light irradiation step of forming the main resin layer and the first additional layer by irradiating light onto the first photomask overlaid entity from the first photomask side to thereby cure portions, in the first photocurable resin layer, corresponding to the light transmission sections of the first photomask;

a first photomask removal step of removing the first photomask from the first photomask overlaid entity;

a second photocurable resin coating step of forming an intermixed photocurable resin layer together with uncured photocurable resin of the first photocurable resin layer, by coating the first additional layer with photocurable resin;

a second photomask overlaying step of forming a second photomask overlaid entity by disposing, on the intermixed photocurable resin layer, a second photomask having a light transmission section corresponding to a structure of the second additional layer;

a second light irradiation step of forming the second additional layer by irradiating light onto the second photomask overlaid entity from the second photomask side to thereby cure a portion, in the photocurable resin layer, corresponding to the light transmission section of the second photomask; and an uncured resin removal step of removing the second photomask from the second photomask overlaid entity, and removing uncured photocurable resin in the intermixed photocurable resin layer.

7. The screen printing mask according to the above-mentioned embodiment 1 or 2, wherein the additional net-like section is provided on the main mesh by forming a plurality of interconnected resin pieces that are substantially perpendicular to the main mesh.

8. The screen printing mask according to the above-mentioned embodiment 1, 2 or 7, wherein the additional net-like section has a honeycomb shape.

EXPLANATION OF THE REFERENCE NUMERALS

10 screen printing mask (printing mask)
20 main mesh (screen)
30 main resin layer (stencil)
35 through-hole (opening)
40*a*, 140*a* first photocurable resin layer
40*b*, 140*b* second photocurable resin layer
40*ab* fused photocurable resin layer
50A to 50D additional net-like section (hollow cells)
50Aa to 50Da first additional layer
50Ab to 50Db second additional layer
52Aa to 52Da first layer resin pieces
52Ab to 52Db second layer resin pieces
150A to 150D additional net-like section (hollow cells)
152A to 152D resin pieces
60*a*, 160*a* first photomask
60*b*, 160*b* second photomask
300 ink
500A (500) rear glass (material to be printed on)
500B (500) front glass (material to be printed on)
525A, 525B (525) thick section

What is claimed is:

1. A screen printing mask for performing screen printing on a material to be printed on, comprising:

a main mesh;

a main resin layer provided on the main mesh by curing, through absorption of light, photocurable resin that is applied onto the main mesh, the main resin layer having at least one through-hole; and at least one additional net section provided on the main mesh by curing, through absorption of light, photocurable resin that is applied onto the main mesh, the at least one additional net section being disposed within the at least one through-hole of the main resin layer, wherein the at least one additional net section has:

a first additional layer provided on the main mesh together with the main resin layer by curing, through absorption of light, photocurable resin that is applied onto the main mesh within the at least one through-hole of the main resin layer; and a second additional layer provided on the first additional layer by curing, through absorption of light, photocurable resin that is applied onto the first additional layer.

2. The screen printing mask according to claim 1, wherein:

the first additional layer is composed of a plurality of interconnected first layer resin pieces that are substantially perpendicular to the main mesh and are bound directly to the main mesh; and the second additional layer is composed of a plurality of interconnected second layer resin pieces that are substantially perpendicular to the main mesh and are directly bound to the respective interconnected first layer resin pieces so as to extend perpendicularly from the respective interconnected first layer resin pieces.

3. The screen printing mask according to claim 2, wherein the first additional layer and the second additional layer define a honeycomb shape.

4. A method of manufacturing the screen printing mask according to claim 1, comprising:

providing the main resin layer on the main mesh, the main resin layer having at least one through-hole and being formed by curing, through absorption of light, photocurable resin that is applied onto the main mesh; and providing the at least one additional net section on the main mesh within the at least one through-hole of the main resin layer, the at least one additional net section being formed by curing, through absorption of light, photocurable resin that is applied onto the main mesh.

5. The method according to claim 4, wherein providing the main resin layer on the main mesh comprises:

coating the main mesh with the photocurable resin, overlaying a first photomask on the photocurable resin, the first photomask having a light blocking area defining the at least one through-hole, and irradiating the first photomask to cure photocurable resin exposed to the light and to bond the cured photocurable resin to the main mesh.

6. The method according to claim 5, wherein providing the at least one additional net section on the main mesh within the at least one through-hole of the main resin layer comprises:

providing one or more light transmissible areas defining the at least one additional net section within the light blocking area of the first photomask defining the at least one through-hole, wherein the first additional layer of the additional net section is bound to the main mesh when the first photomask is irradiated;

coating the main mesh again with photocurable resin, overlaying a second photomask on the photocurable resin, the second photomask having one or more light transmissible areas defining the at least one additional net section, and irradiating the second photomask to cure photocurable resin exposed to the light and to bound the cured photocurable resin to the first layer of the at least one additional net section.

7. The screen printing mask according to claim 1, wherein the main mesh is a screen material, the main resin layer is a stencil and the at least one additional net section provided on the main mesh is at least one lattice of hollow cells that is directly bound to the screen material within the at least one through-hole of the stencil.

8. The screen printing mask according to claim 7, wherein:

the at least one lattice of hollow cells has a honeycomb shape, and the stencil and at least one lattice of hollow cells are both comprised of the same cross-linked vinyl resin.

9. The screen printing mask according to claim 8, wherein the main mesh is a woven fabric or a metal wire screen.

10. The screen printing mask according to claim 1, wherein the main resin layer is liquid impermeable and blocks ink from passing through the main mesh to reach the material to be printed on; and the at least one additional net section is ink-permeable and allows ink to pass through the main mesh to the material to be printed on.

11. The screen printing mask according to claim 1, wherein the at least one additional net section is thicker than an edge of the main resin layer defining the at least one through-hole and is configured to space the main mesh farther from the material to be printed on than the main resin layer when a squeegee presses the screen printing mask against the material to be printed on, such that a greater amount of ink is deposited below the main mesh through the at least one additional net section than at another through-hole of the main resin layer having no net section.

12. The screen printing mask according to claim 1, wherein the main resin layer has a maximum thickness of 6 μm and the at least one additional net section has a thickness of 66 μm.

13. The screen printing mask according to claim 1, wherein, in a cross-section parallel to the main mesh that extends through the at least one additional net section, open spaces in the at least one additional net section comprise at least 60% of a total area of the at least one additional net section and vertical walls constituting the at least one additional net section comprise less than 40% of the total area of the at least one additional net section.

14. The screen printing mask according to claim 1, wherein:

the main mesh is an ink-permeable screen material made of a woven fabric or metal wires, the main resin layer is an ink-impermeable stencil disposed on top of, and directly bound to, a first planar surface of the ink-permeable screen material and the at least one additional net section provided on the main mesh is at least one lattice of ink-permeable hollow cells disposed on top of, and directly bound to, the first planar surface of the screen material within the at least one through-hole of the main resin layer, the at least one lattice of ink-permeable hollow cells being configured to allow ink to pass through the main mesh to the material to be printed on.

15. The screen printing mask according to claim 14, wherein:

the ink-permeable screen material defines a plane, the at least one lattice of ink-permeable hollow cells has a first thickness in a depth direction that is perpendicular to the plane, the ink-impermeable stencil, at an edge of the ink-impermeable stencil that defines the at least one through-hole of the ink-impermeable stencil, has a second thickness in the depth direction and the first thickness is greater than the second thickness.

16. The screen printing mask according to claim 1, wherein:

the at least one additional net section is formed as at least one lattice of hollow cells that comprises a plurality of interconnected vertical walls, each of the vertical walls is formed by the first additional layer of the at least one additional net section cross-linked to the second additional layer of the at least one additional net section, all of the interconnected vertical walls are directly bound to the main mesh, and all of the interconnected vertical walls of the at least one lattice of hollow cells are composed of the same photo-cured resin as the main resin layer.

17. The screen printing mask according to claim 16, wherein the main resin layer and the first additional layer of the at least one additional net section have the same thickness at an edge of the main resin layer that defines the at least one through-hole of the main resin layer.

18. The screen printing mask according to claim 17, wherein:

the main resin layer has a first surface and a second surface opposite of the first surface, the first surface being bound to the main mesh, and the second additional layer of the at least one additional net section protrudes beyond a plane defined by the second surface of the main resin layer.

19. A screen printing mask for performing screen printing on a material to be printed on, comprising:

a main mesh;

a main resin layer provided on the main mesh by curing, through absorption of light, photocurable resin that is applied onto the main mesh, the main resin layer having at least one through-hole; and at least one additional net section provided on the main mesh by curing, through absorption of light, photocurable resin that is applied onto the main mesh, the at least one additional net section being disposed within the at least one through-hole of the main resin layer, wherein the at least one additional net section has:

a first additional layer provided on the main mesh together with the main resin layer by curing, through absorption of light, photocurable resin that is applied onto the main mesh within the at least one through-hole of the main resin layer; and a second additional layer provided on the first additional layer by curing, through absorption of light, photocurable resin that is applied onto the first additional layer, and wherein:

the main mesh is an ink-permeable screen material made of a woven fabric or metal wires, the main resin layer is an ink-impermeable stencil disposed on top of, and directly bound to, a first planar surface of the ink-permeable screen material and the at least one additional net section provided on the main mesh is at least one lattice of ink-permeable hollow cells disposed on top of, and directly bound to, the first planar surface of the screen material within the at least one through-hole of the main resin layer, the at least one lattice of ink-permeable hollow cells being configured to allow ink to pass through the main mesh to the material to be printed on, the ink-permeable screen material defines a plane, the at least one lattice of ink-permeable hollow cells has a first thickness in a depth direction that is perpendicular to the plane, the ink-impermeable stencil has a second thickness in the depth direction and the first thickness is greater than the second thickness, in a cross-section parallel to the main mesh that extends through the at least one additional net section, open spaces in the at least one additional net section comprise at least 70% of a total area of the at least one additional net section and vertical walls constituting the at least one additional net section comprise less than 30% of the total area of the at least one additional net section, the second thickness is 6 μm, the first thickness is 66 μm and the main resin layer and the vertical walls of the at least one additional net section are both made of the same cross-linked polymer, which is a different material from the screen material.

20. The screen printing mask according to claim 19, wherein all of the vertical walls of the at least one additional net section are directly bound to the main mesh.

21. The screen printing mask according to claim 20, wherein the main resin layer has a thickness of 6 μm at an edge of the main resin layer that defines the at least one through-hole of the main resin layer.

22. A screen printing mask for performing screen printing on a material to be printed on, comprising:

a main mesh composed of a woven fabric or a metal wire screen;

a main resin layer directly bound to the main mesh, the main resin layer forming a stencil that has at least one through-hole; and at least one additional net section disposed within the at least one through-hole of the main resin layer, the at least one additional net section being formed as at least one lattice of hollow cells that comprises a plurality of interconnected vertical walls, wherein each of the vertical walls of the at least one additional net section is composed of a first additional layer having a first side that is directly bound to the main mesh and a second additional layer that is superimposed on, and directly cross-linked to, a second side of the first additional layer, the main resin layer and at least the first additional layer of the at least one additional net section are composed of the same photo-cured resin, the main resin layer and the first additional layer of the at least one additional net section have the same thickness at an edge of the main resin layer that defines the at least one through-hole of the main resin layer, the main resin layer has a first surface and a second surface opposite of the first surface, the first surface being bound to the main mesh, and the second additional layer of the at least one additional net section protrudes beyond a plane defined by the second surface of the main resin layer.

* * * * *